US011873182B2

(12) United States Patent
Maeda

(10) Patent No.: US 11,873,182 B2
(45) Date of Patent: Jan. 16, 2024

(54) SHEET-SHAPED-MEDIUM FEEDER AND HANDLING APPARATUS

(71) Applicant: FUJIFILM BUSINESS INNOVATION CORP., Tokyo (JP)

(72) Inventor: Shoichi Maeda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 93 days.

(21) Appl. No.: 17/463,910

(22) Filed: Sep. 1, 2021

(65) Prior Publication Data

US 2022/0371838 A1 Nov. 24, 2022

(30) Foreign Application Priority Data

May 24, 2021 (JP) ..... 2021-086862

(51) Int. Cl.

| | |
|---|---|
| ***B65H 3/48*** | (2006.01) |
| ***B65H 3/12*** | (2006.01) |
| ***B65H 3/14*** | (2006.01) |
| ***B65H 1/08*** | (2006.01) |
| ***B65H 7/16*** | (2006.01) |

(52) U.S. Cl.

CPC ..... *B65H 3/48* (2013.01); *B65H 1/08* (2013.01); *B65H 3/128* (2013.01); *B65H 3/14* (2013.01); *B65H 7/16* (2013.01); *B65H 2511/15* (2013.01); *B65H 2511/51* (2013.01); *B65H 2801/06* (2013.01)

(58) Field of Classification Search

CPC ... B65H 1/08; B65H 1/14; B65H 1/18; B65H 3/12; B65H 3/124; B65H 3/128; B65H 3/48; B65H 7/02; B65H 7/06; B65H 7/16; B65H 2406/12; B65H 2406/121; B65H 2511/15

See application file for complete search history.

(56) References Cited

U.S. PATENT DOCUMENTS

| | | | | |
|---|---|---|---|---|
| 2004/0089994 A1* | 5/2004 | Koga | ..... | B65H 3/128 271/98 |
| 2006/0012107 A1* | 1/2006 | Ueda | ..... | B65H 3/128 271/30.1 |

(Continued)

FOREIGN PATENT DOCUMENTS

JP 2020-015607 A 1/2020

*Primary Examiner* — Prasad V Gokhale

(74) *Attorney, Agent, or Firm* — Oliff PLC

(57) ABSTRACT

A feeder includes a mount board that moves vertically while allowing sheet-shaped media to be stacked thereon; a transport device allows an uppermost one of the sheet-shaped media stacked on the mount board to be sucked by a suction portion to transport the uppermost medium to a transporter and to feed the uppermost medium to a destination; left and right edge air blowers blow air to transportation left and right edge portions of upper ones of the sheet-shaped media stacked; and a tip-end air blower blows air to below the uppermost medium sucked by the suction portion from a position downstream from a transportation leading end of the uppermost medium in a transport direction. When the uppermost medium is sucked by the suction portion, the feeder performs a first operation of spacing an upwardly bent transportation leading-end portion of a second uppermost medium apart downward from the sucked uppermost medium.

12 Claims, 15 Drawing Sheets

(56) References Cited

U.S. PATENT DOCUMENTS

| | | | | |
|---|---|---|---|---|
| 2012/0154795 | A1* | 6/2012 | Kobayashi | B65H 3/5261 356/213 |
| 2015/0021848 | A1* | 1/2015 | Mizuno | B65H 5/228 271/12 |
| 2015/0183595 | A1* | 7/2015 | Yokoya | B65H 3/48 271/157 |
| 2019/0233226 | A1* | 8/2019 | Nakamura | B65H 3/48 |
| 2020/0031599 | A1 | 1/2020 | Okano | |

* cited by examiner

SHEET-SHAPED-MEDIUM FEEDER AND HANDLING APPARATUS

CROSS-REFERENCE TO RELATED APPLICATIONS

This application is based on and claims priority under 35 USC 119 from Japanese Patent Application No. 2021-086862 filed May 24, 2021.

BACKGROUND

(i) Technical Field

The present disclosure relates to a sheet-shaped-medium feeder and a handling apparatus.

(ii) Related Art

Japanese Unexamined Patent Application Publication No. 2020-15607 (for example, paragraphs 0020 to 0043 and FIGS. 3 and 4) describes a sheet feeder including a sheet mount, a tip-end air blower, a side-edge air blower, a suction let-off portion, and a transporter. The sheet mount receives a stack of multiple sheets and is supported to be vertically movable. The tip-end air blower includes a nozzle to blow air in a direction slightly inclined upward with respect to a downstream side of a sheet feeding direction. The side-edge air blower includes a nozzle to blow air in, for example, a horizontal direction toward sheets from right and left sides of the uppermost sheet located at a restricted height. The suction let-off portion includes a belt mechanism and a suction duct located inside the belt to suck and feed the uppermost sheet. The transporter includes an insertion guide and a transport roller that transports a sheet fed by the suction let-off portion in the sheet feeding direction.

SUMMARY

Aspects of non-limiting embodiments of the present disclosure relate to a sheet-shaped-medium feeder and a handling apparatus capable of preventing an overlap transport of sheet-shaped media regardless of when at least one of the sheet-shaped media stacked on a mount board has a transportation leading end bent upward.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a feeder that includes a mount board that moves vertically while allowing sheet-shaped media to be stacked thereon; a transport device that allows an uppermost one of the sheet-shaped media stacked on the mount board to be sucked by a suction portion to transport the uppermost sheet-shaped medium to a transporter and to feed the uppermost sheet-shaped medium to a destination; left and right edge air blowers that blow air to transportation left and right edge portions of upper ones of the sheet-shaped media stacked; and a tip-end air blower that blows air to below the uppermost sheet-shaped medium sucked by the suction portion from a position downstream from a transportation leading end of the uppermost sheet-shaped medium in a transport direction, wherein when the uppermost sheet-shaped medium is sucked by the suction portion, the feeder performs a first operation of spacing an upwardly bent transportation leading-end portion of a second uppermost sheet-shaped medium apart downward from the sucked uppermost sheet-shaped medium.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
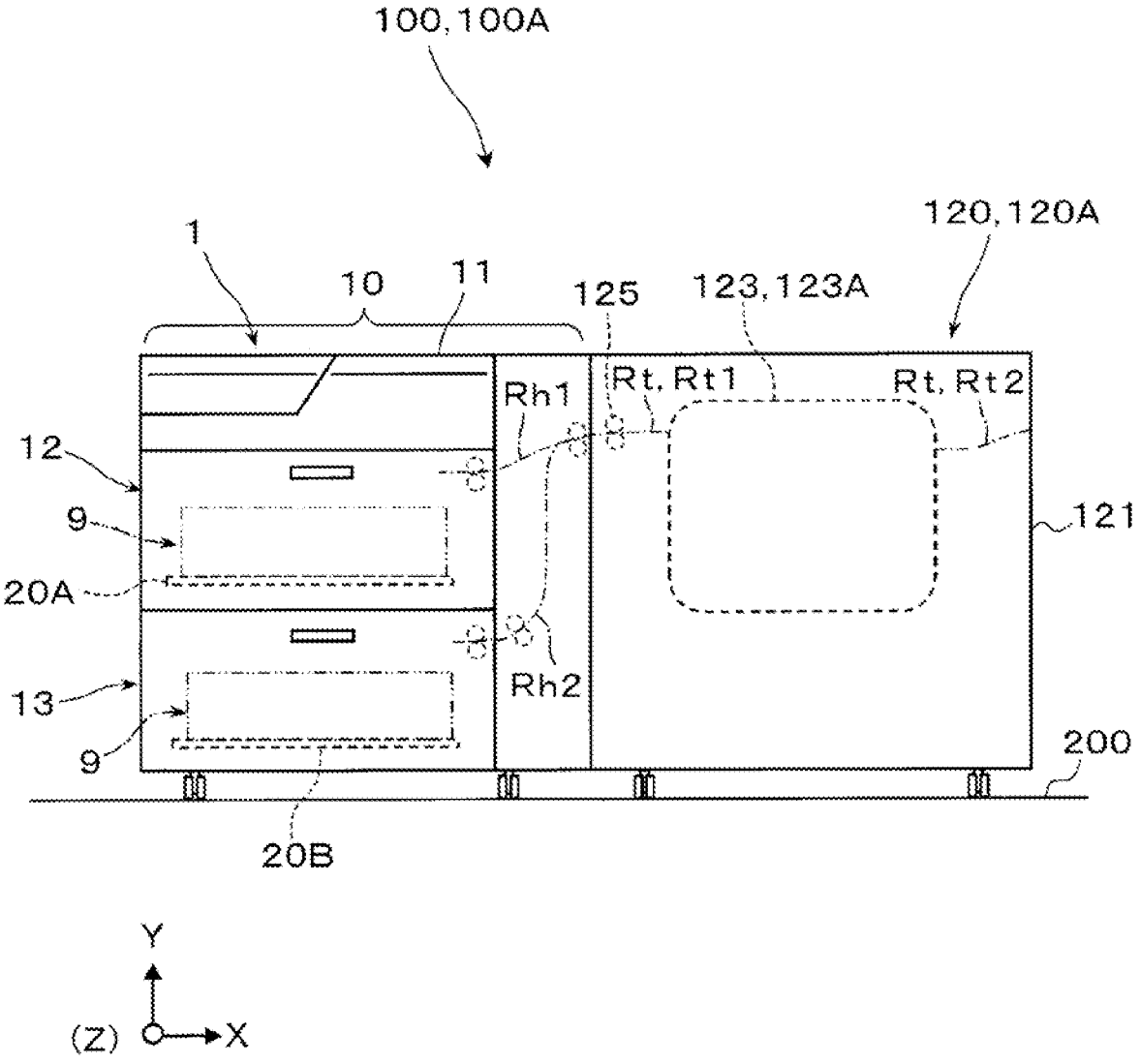
FIG. 1 is a side view of a sheet-shaped-medium handling apparatus according to a first exemplary embodiment.
Figure 2:
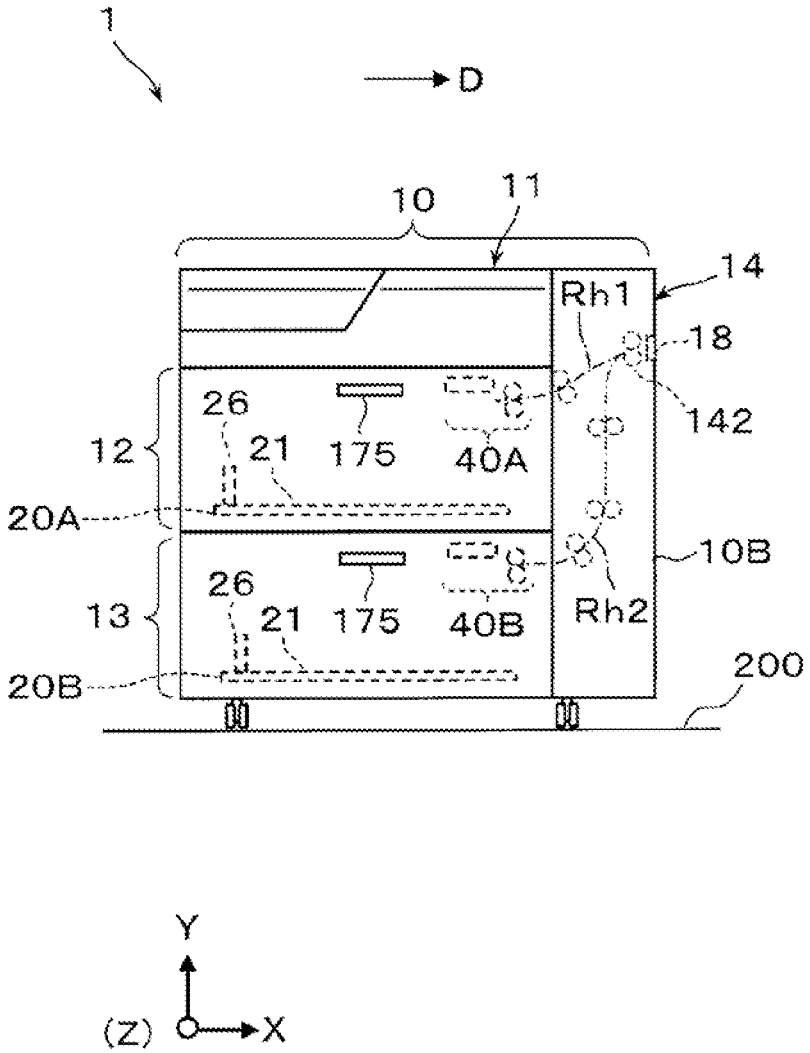
FIG. 2 is a side view of a sheet-shaped-medium feeder according to the first exemplary embodiment.

FIG. 1 illustrates a sheet-shaped-medium handling apparatus 100 according to a first exemplary embodiment. FIG. 2 illustrates a sheet-shaped-medium feeder 1 according to the first exemplary embodiment.

In the following description, throughout the drawings, the direction indicated with arrow X is referred to as an apparatus width direction, the direction indicated with arrow Y is referred to as an apparatus height direction, and the direction indicated with arrow Z is referred to as an apparatus depth direction perpendicular to the width direction and the height direction. A circle in the drawings at the intersection of the arrow X and the arrow Y denotes the apparatus depth direction (arrow Z) directing downward from the drawing sheet, or perpendicular to the drawing sheet.

Sheet-Shaped-Medium Handling Apparatus

As illustrated in FIG. 1, the sheet-shaped-medium handling apparatus 100 includes the sheet-shaped-medium feeder 1, which transports and feeds sheet-shaped media 9 stacked thereon, and a processing device 120, which performs processing on the sheet-shaped media 9 fed from the feeder 1.

The sheet-shaped media 9 are sheet-like media that are receivable in and transportable by the feeder 1 and transportable and processible by the processing device 120. An image forming system 100A and other portions are installed on an installation surface 200 illustrated in FIG. 1.

The sheet-shaped-medium handling apparatus 100 includes an image forming apparatus 120A that forms images on the sheet-shaped media 9 to serve as the processing device 120. The processing device 120 is connected to and combined with the feeder 1 to form the image forming system 100A.

Examples used as the sheet-shaped media 9 include recording media that allow images to be formed thereon, such as paper sheets, coated paper, films, foil, and sheet-like cloth cut into predetermined sizes, and envelopes.

As illustrated in FIG. 1, the image forming apparatus 120A, serving as an example of the processing device 120, includes an image forming unit 123A and transport paths Rt inside a housing 121 with a predetermined profile. The image forming unit 123A forms images on the sheet-shaped media 9 and serves as an example of a processing unit 123. Each transport path Rt allows the sheet-shaped media 9 to be transported along itself inside the housing 121.

The image forming unit 123A has, for example, an image forming system such as an electrophotographic system or an inkjet recording system. However, the image forming system, layout, the number of units, and other details of the image forming unit 123A are not limited to particular ones.

An introduction transport path Rt1 indicated with a dot-and-dash line in FIG. 1 allows the sheet-shaped media 9 fed from the feeder 1 to be transported along itself and introduced into the image forming unit 123A. The introduction transport path Rt1 includes transport rollers 125, and a transport guide. A discharge transport path Rt2 indicated with a dot-and-dash line allows the sheet-shaped media 9 that have passed the image forming unit 123A to be transported along itself and discharged to a receiving portion or a post-processing unit, not illustrated. The discharge transport path Rt2 includes transport rollers and a transport guide, not illustrated.

In the image forming system 100A, when the sheet-shaped media 9 are fed from the feeder 1 to the image forming apparatus 120A, which is an example of the processing device 120, the image forming apparatus 120A forms images on the fed sheet-shaped media 9.

Sheet-Shaped-Medium Feeder

As illustrated in FIGS. 1 and 2, the sheet-shaped-medium feeder 1 includes a housing 10 serving as a body accommodating and feeding the sheet-shaped media 9.

Figure 3:
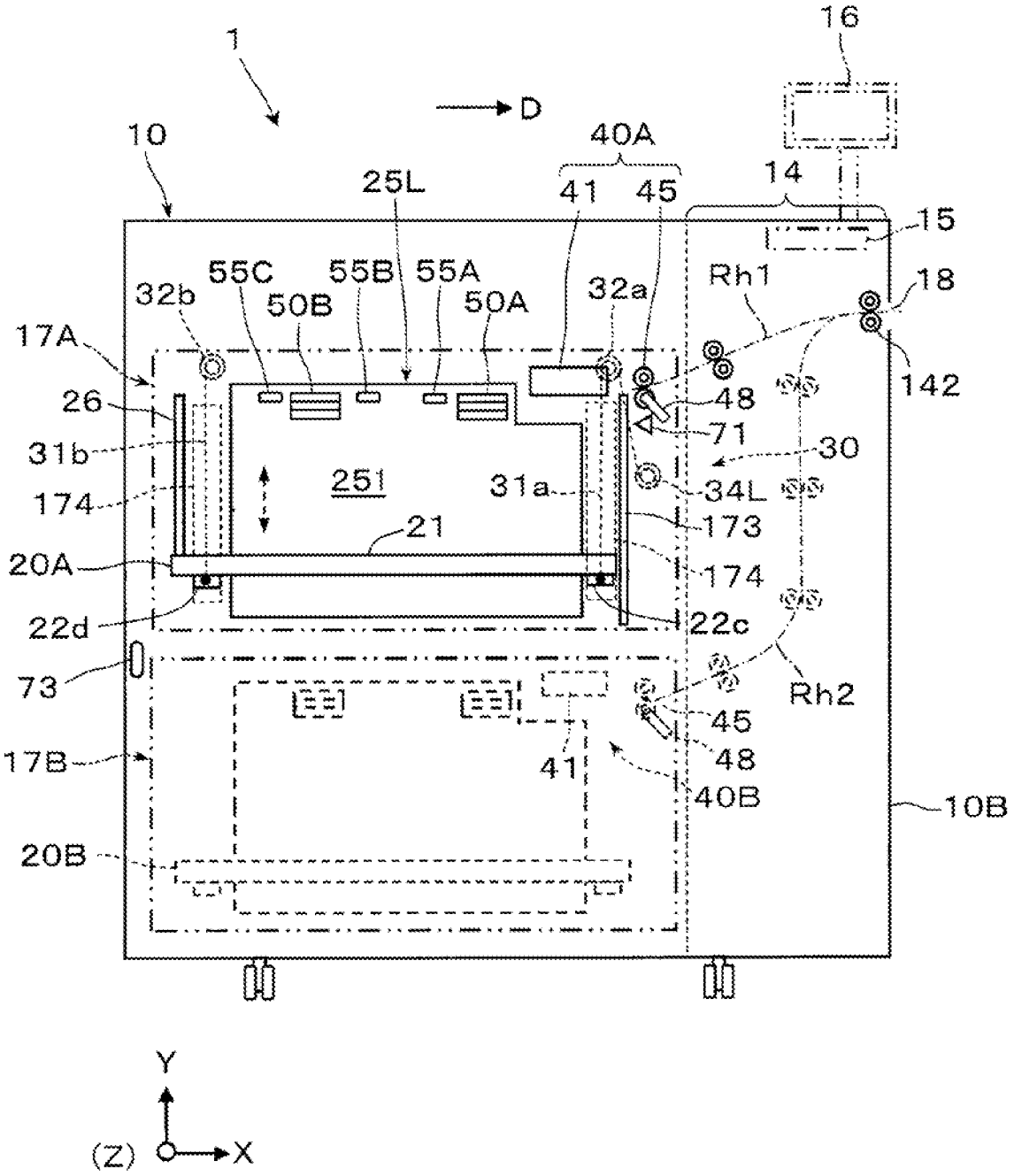
FIG. 3 is a schematic view of an inside of the feeder viewed from a side.

The housing 10 includes a support frame forming a predetermined skeleton structure, and an exterior panel forming the appearance. As illustrated in FIGS. 1 to 3, the housing 10 roughly includes an upper portion 11, feed units 12 and 13 located below the upper portion 11 and vertically stacked one on the other (upper and lower units), and a discharge portion 14 disposed at an end of the upper portion 11 and the feed units 12 and 13 on one side.

As illustrated in FIGS. 1 to 4 and other drawings, the feed unit 12 on the upper side and the feed unit 13 on the lower side include containers 17A and 17B, such as trays, mount portions 20A and 20B that receive the sheet-shaped media 9, lifts 30 that vertically raise and lower the mount portions 20A and 20B inside the containers 17A and 17B, and dischargers 40A and 40B that discharge the sheet-shaped media 9 respectively stacked on the mount portions 20A and 20B toward the discharge portion 14 in the direction of arrow D (in the transportation direction D).

The containers 17A and 17B are attached to be drawable to the near side (upstream side in the apparatus depth direction Z) of the housing 10.

The containers 17A and 17B each include side wall boards at an upstream end and a downstream end in the apparatus depth direction Z, and a body that is open in the apparatus width direction X. On the wall board on the upstream side in the apparatus depth direction Z, a front wall 172 is attached. A pull opening 175 is formed at an upper portion of the front wall 172.

Figure 4:
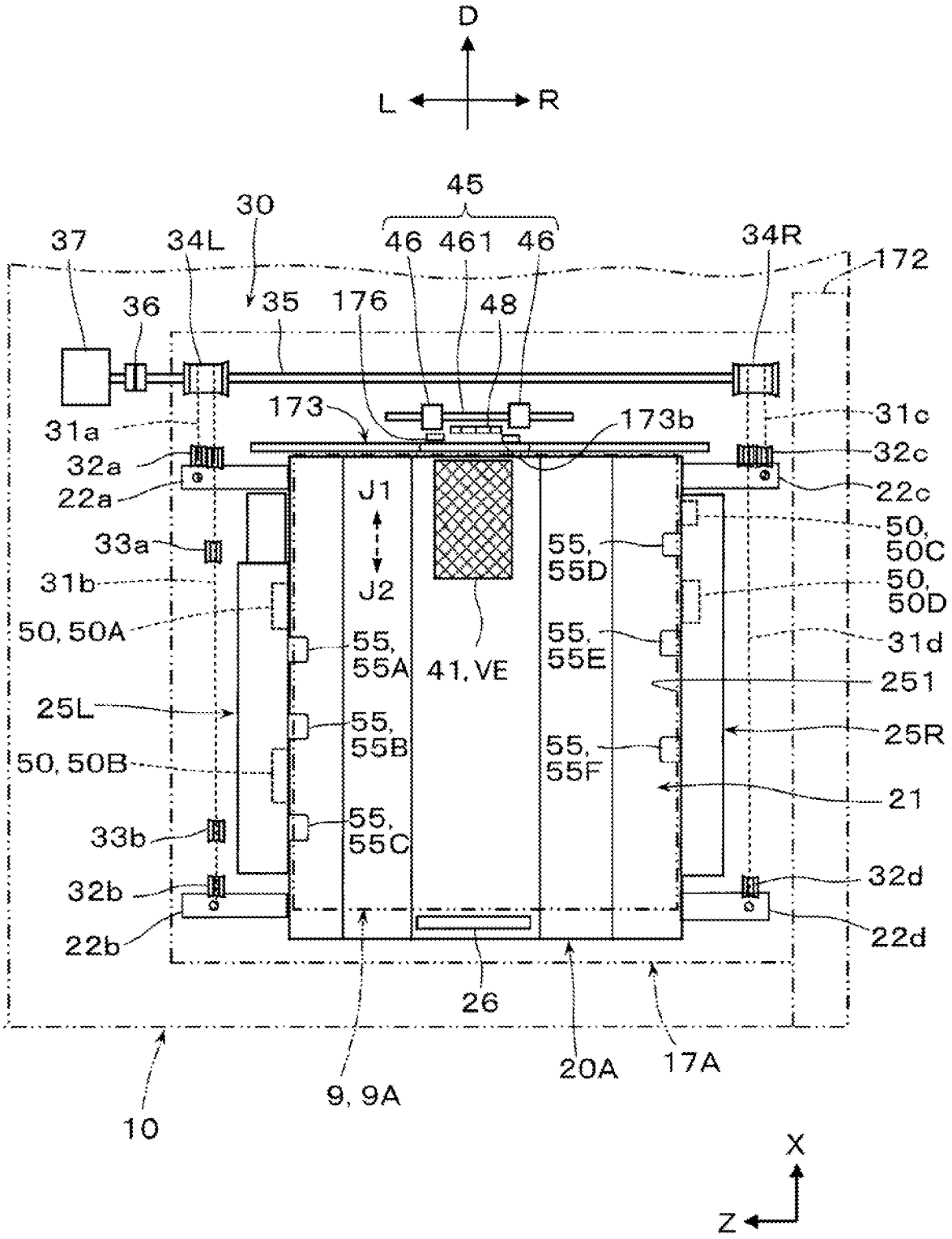
FIG. 4 is a schematic view of the inside of the feeder viewed from above.
Figure 7:
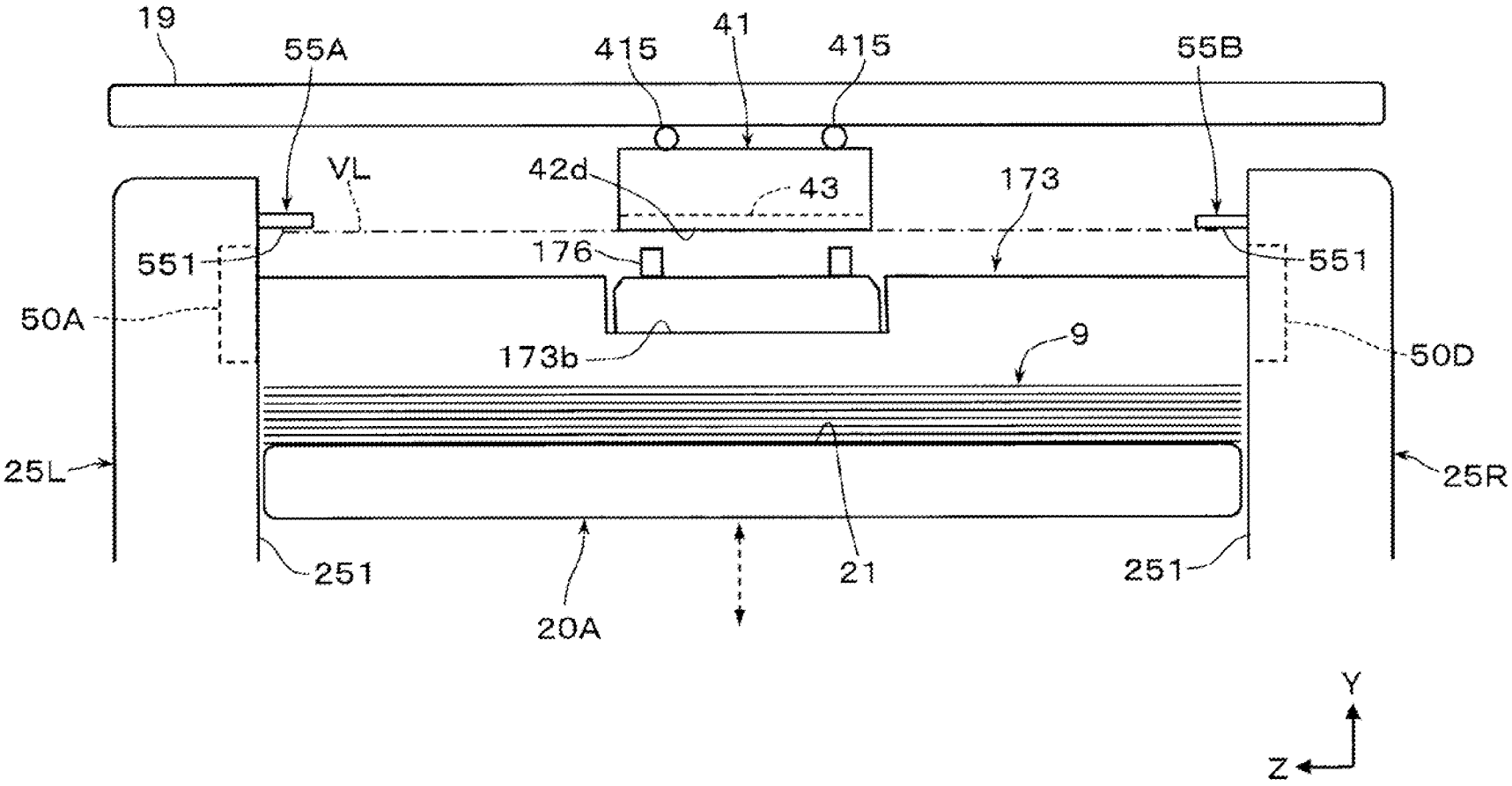
FIG. 7 is a schematic view of components of the feeder such as a suction portion viewed from the upstream side in a transportation direction.

The containers 17A and 17B each include a leading-end wall 173, and a moving device, not illustrated. The leading-end wall 173 is located at one open end (downstream end in the transportation direction D) of the body, and aligns transportation leading ends 9*s* of the sheet-shaped media 9, on the downstream side in the transportation direction D, stacked on the mount portion 20A or 20B for positioning. The moving device includes slide rails and a latch mechanism disposed between the left and right side portions of the body in the pull-out direction and the inner wall of the housing 10. As illustrated in FIGS. 4 and 7, the leading-end wall 173 has a cut recess 173*b* at the middle at the upper end of the leading-end wall 173.

The mount portions 20A and 20B are plate members (mount boards) each having a mount surface 21 that receives the sheet-shaped media 9 on the upper portion. The mount portions 20A and 20B are installed in the containers 17A and 17B to be vertically movable.

The mount portions 20A and 20B have the same structure. Thus, the mount portion 20A will be described below as an example except when particularly needed.

As illustrated in FIGS. 3 and 4 and other drawings, the mount portion 20A includes hanging portions 22*a*, 22*b*, 22*c*, and 22*d* protruding from the left and right edge portions on the left and right sides when viewed from the downstream side in the transportation direction D of the sheet-shaped media 9. The hanging portions 22*a*, 22*b*, 22*c*, and 22*d* are guided along guide holes 174 formed in the side wall boards in the body of the container 17A to be vertically movable. The mount portion 20A is movable by at least vertical dimensions of the guide holes 174.

As illustrated in FIGS. 2 to 4 and other drawings, the mount portion 20A includes left and right side walls 25L and 25R and a rear end wall 26 on the mount surface 21. As illustrated in FIG. 4, the left (L) and right (R) correspond to the left side and the right side when viewed from the upstream side in the transportation direction D.

Figure 5:
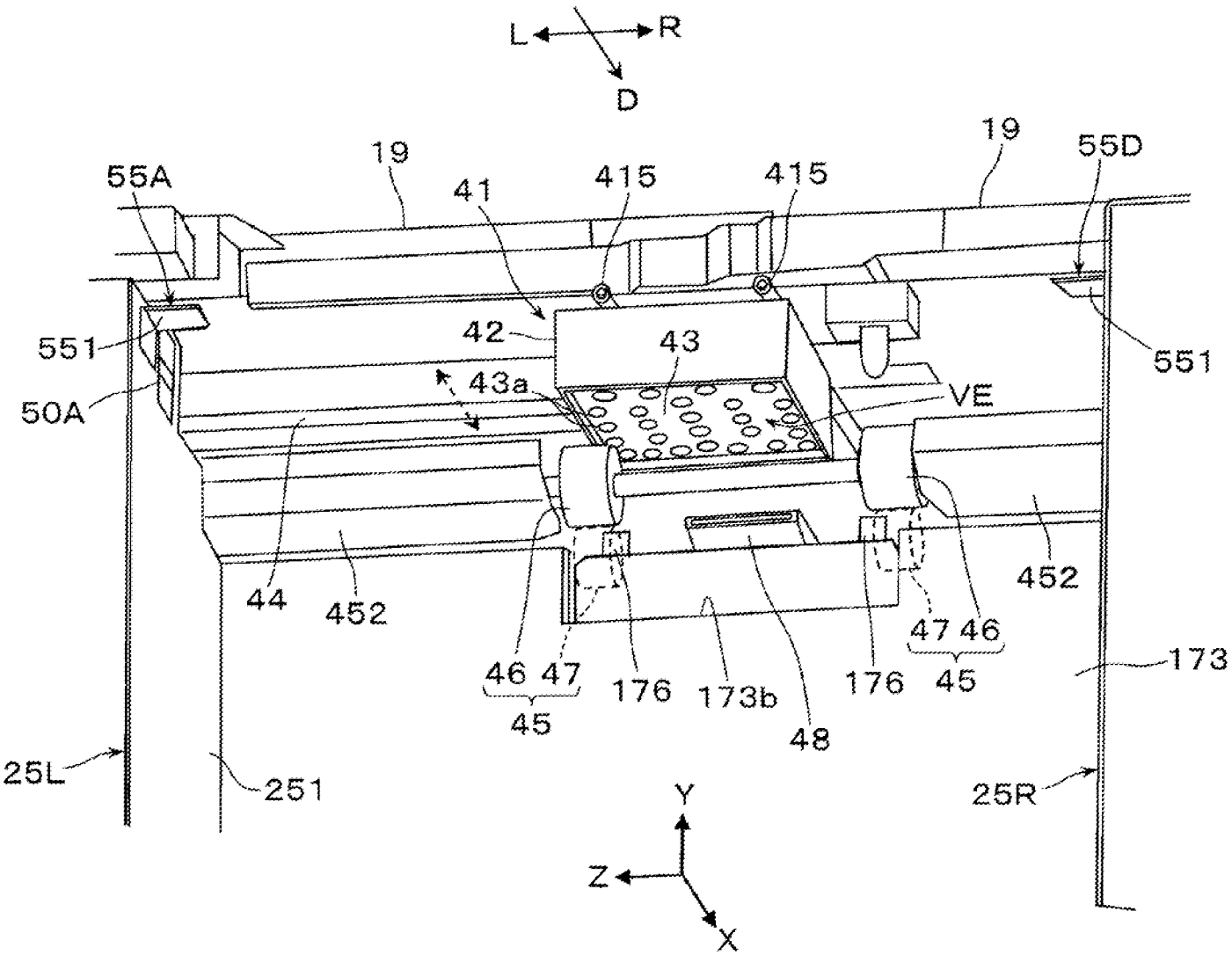
FIG. 5 is a schematic view of components of the feeder such as a suction portion and a transporter viewed from obliquely below.

As illustrated in FIGS. 4 and 5, each of the side walls 25L and 25R includes a contact surface 251 that comes into contact with the left or right edges of the sheet-shaped medium 9 to align and fix the positions of the transportation left and right edge portions of the sheet-shaped medium 9 stacked on the mount surface 21 with the contact surfaces 251, and to guide the left or right edges in the transportation direction D. The feed units 12 and 13 transport the sheet-shaped media 9 while using the center position of the sheet-shaped media 9 in the feed width direction as a reference position for transportation, that is, while employing a center registration method. Thus, the side walls 25L and 25R are movable as a whole in the leftward and rightward directions L and R over the bottom of the containers 17A and 17B.

The rear end wall 26 has a contact surface that comes into contact with the trailing ends of the sheet-shaped media 9. The contact surface aligns the trailing ends of the sheet-shaped media 9, on the upstream side in the transportation direction D, to fix the positions of the trailing ends. The entirety of the rear end wall 26 is movable with respect to slide grooves extending in the transportation direction D and formed in a fixed surface portion (not illustrated) of the mount surface 21.

As shown in FIGS. 3 and 4 and other drawings, the lift 30 includes four wires 31*a*, 31*b*, 31*c*, and 31*d*, winding pulleys 32*a*, 32*b*, 32*c*, and 32*d* and auxiliary pulleys 33*a* and 33*b* around each of which any of the wires 31*a*, 31*b*, 31*c*, and 31*d* is wound, a left taking-up pulley 34L, a right taking-up pulley 34R, and a lift driving apparatus 37.

The four wires 31*a*, 31*b*, 31*c*, and 31*d* have trailing ends respectively coupled to the hanging portions 22*a*, 22*b*, 22*c*, and 22*d* disposed at four positions of the mount portion 20A.

The winding pulleys 32*a*, 32*b*, 32*c*, and 32*d* are rotatably attached to respective portions in the container 17A above the upper ends of the guide holes 174 in the left and right side wall boards in the container 17A. The auxiliary pulleys 33*a* and 33*b* are rotatably attached to the side wall board of the container 17A to allow the wires 31*a* and 31*b* to be wound therearound so that the wires 31*a* and 31*b* are intendedly routed between the winding pulleys 32*a* and 32*b* and the left taking-up pulley 34L.

The left taking-up pulley 34L is disposed on the bottom surface of the container 17A to take up the wires 31*a* and 31*b* disposed on the left. The right taking-up pulley 34R is disposed on the bottom surface of the container 17A to take up the wires 31*c* and 31*d* disposed on the right.

The lift driving apparatus 37 includes components including a motor and a gear mechanism and rotates in a direction switchable between forward and reverse directions. The lift driving apparatus 37 is disposed at a portion on a far side of the housing 10. The left taking-up pulley 34L and the right taking-up pulley 34R are attached to the lift driving apparatus 37. One end portion of a rotatable rotation shaft 35 is coupled to the bottom surface of the container 17A via a detachably connectable coupling mechanism 36.

The lift 30 drives the lift driving apparatus 37 to rotate by a predetermined amount in a desired direction to take up the wires 31*a*, 31*b*, 31*c*, and 31*d* to raise the mount portion 20A. The lift 30 also drives the lift driving apparatus 37 to rotate by a predetermined amount in the reverse direction to unwind the wires 31*a*, 31*b*, 31*c*, and 31*d* to lower the mount portion 20A.

The driving of the lift driving apparatus 37 is controlled using detection information from a height position sensor 71 that detects the uppermost position of the sheet-shaped media 9 stacked on the mount portion 20A. More specifically, the lift driving apparatus 37 stops driving upon obtaining information that the uppermost position of the sheet-shaped media 9 detected by the height position sensor 71 arrives at a predetermined height position. As illustrated in, for example, FIGS. 3 and 6, the height position sensor 71 is disposed, for example, to detect the uppermost position (height position) of the sheet-shaped media 9 viewable through the cut recess 173*b* in the leading-end wall 173 of the container 17A.

Figure 6:
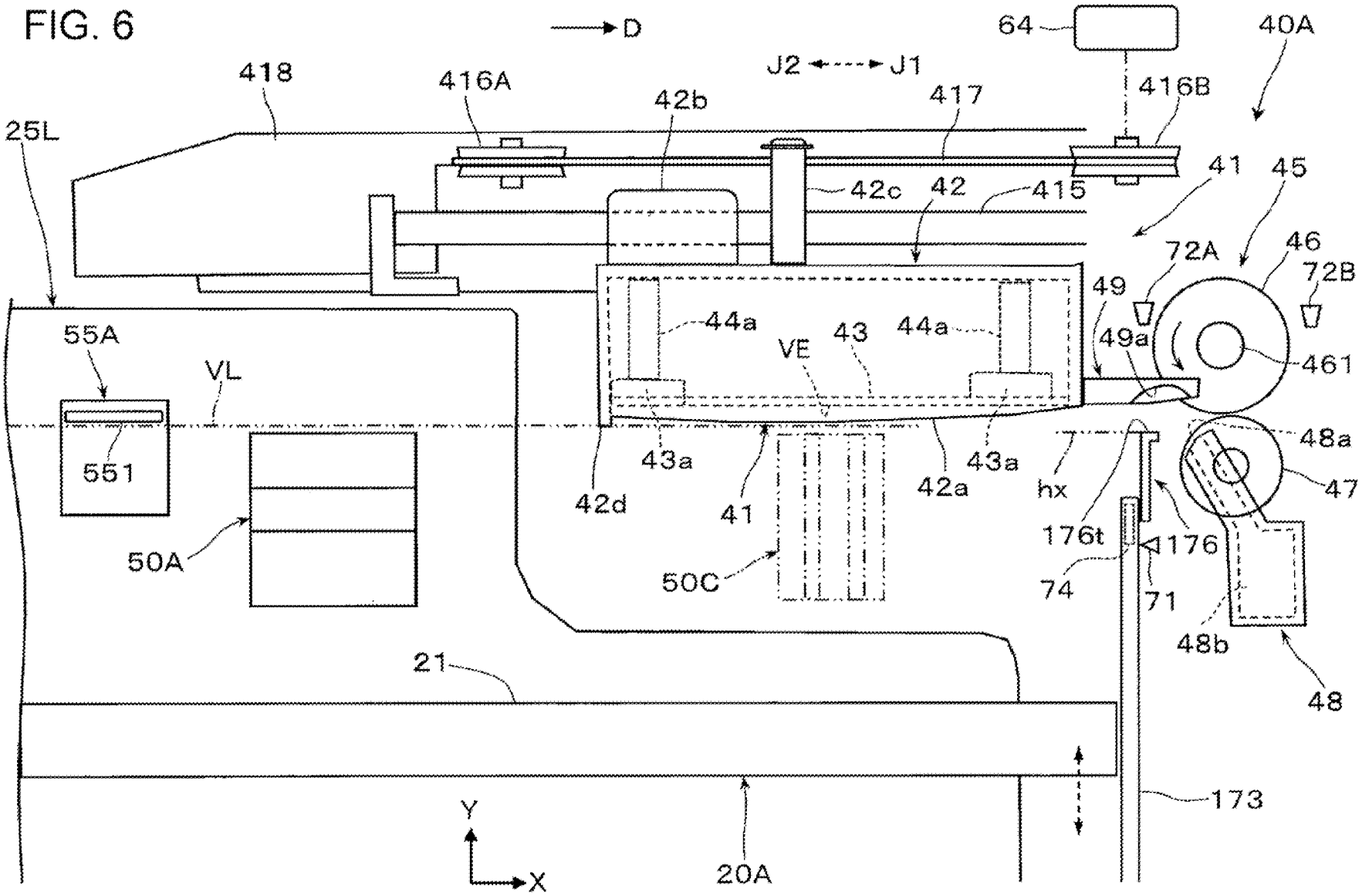
FIG. 6 is a schematic view of components of the feeder such as a suction portion and a transporter viewed from a side.

As illustrated in FIGS. 3, 4, and 6 and other drawings, in the mount portion 20A, the side walls 25L and 25R each include left and right air outlets 50 in the contact surface 251. The left and right air outlets 50 blow air to the left and right edge portions of upper ones of the sheet-shaped media 9 stacked on the mount portion 20A or 20B. The left and right air outlets 50 form part of left and right edge air blowers.

As illustrated in FIG. 4 and other drawings, the air outlets 50 include two air outlets 50A and 50B formed in the left side wall 25L and spaced apart from each other in the transportation direction D, and two air outlets 50C and 50D formed in the right side wall 25R and spaced apart from each other in the transportation direction D. The air outlets 50A and 50D are disposed to oppose each other in the transportation direction D. The left air outlets 50A and 50B each have, for example, an outlet through which air is actually blown out in the shape of a long hole extending in the horizontal direction. The right air outlets 50C and 50D each have, for example, an outlet through which air is actually blown out in the shape of a long hole extending in the vertical direction.

Figure 8:
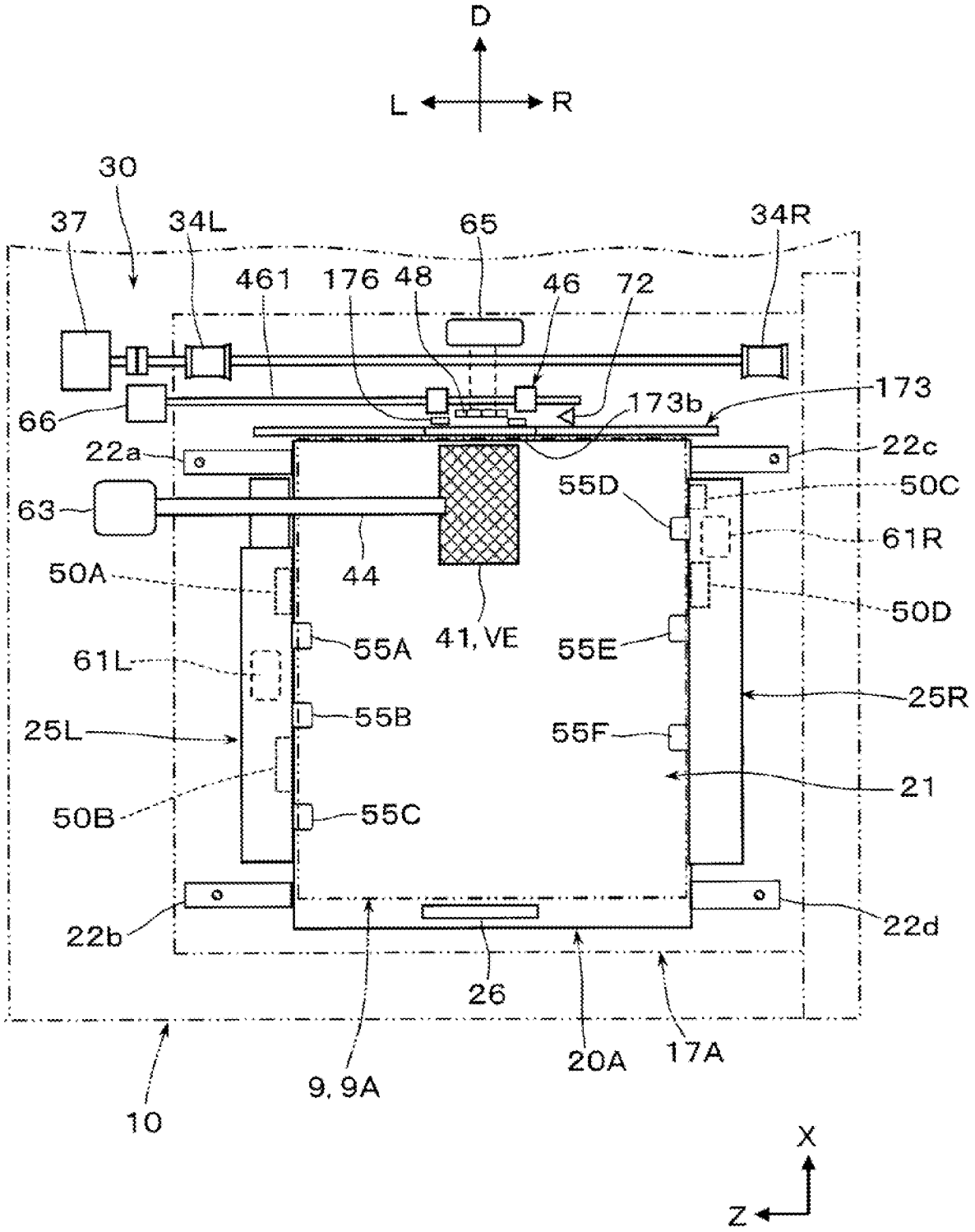
FIG. 8 is a schematic view of a structure of a driving system of the feeder viewed from above.

As illustrated in FIG. 8, the air outlets 50A and 50B are connected to a left edge air blowing device 61L via a blast duct not illustrated. The left edge air blowing device 61L forms a remaining portion of a left edge air blower disposed on the inner side of the left side wall 25L. The air outlets 50C and 50D are connected to a right edge air blowing device 61R via a blast duct not illustrated. The right edge air blowing device 61R forms a remaining portion of a right edge air blower disposed on the inner side of the right side wall 25R. Although not illustrated, open-close valves that open and close the flow paths in the blast ducts are disposed at the edge air blowing devices 61L and 61R.

The left and right edge air blowers blow air to the left and right edge portions of upper ones of the sheet-shaped media 9 stacked on the mount surface 21 through the air outlets 50A, 50B, 50C, and 50D when a suction portion 41, described below, of the dischargers 40A and 40B sucks the sheet-shaped media 9.

Figure 10:
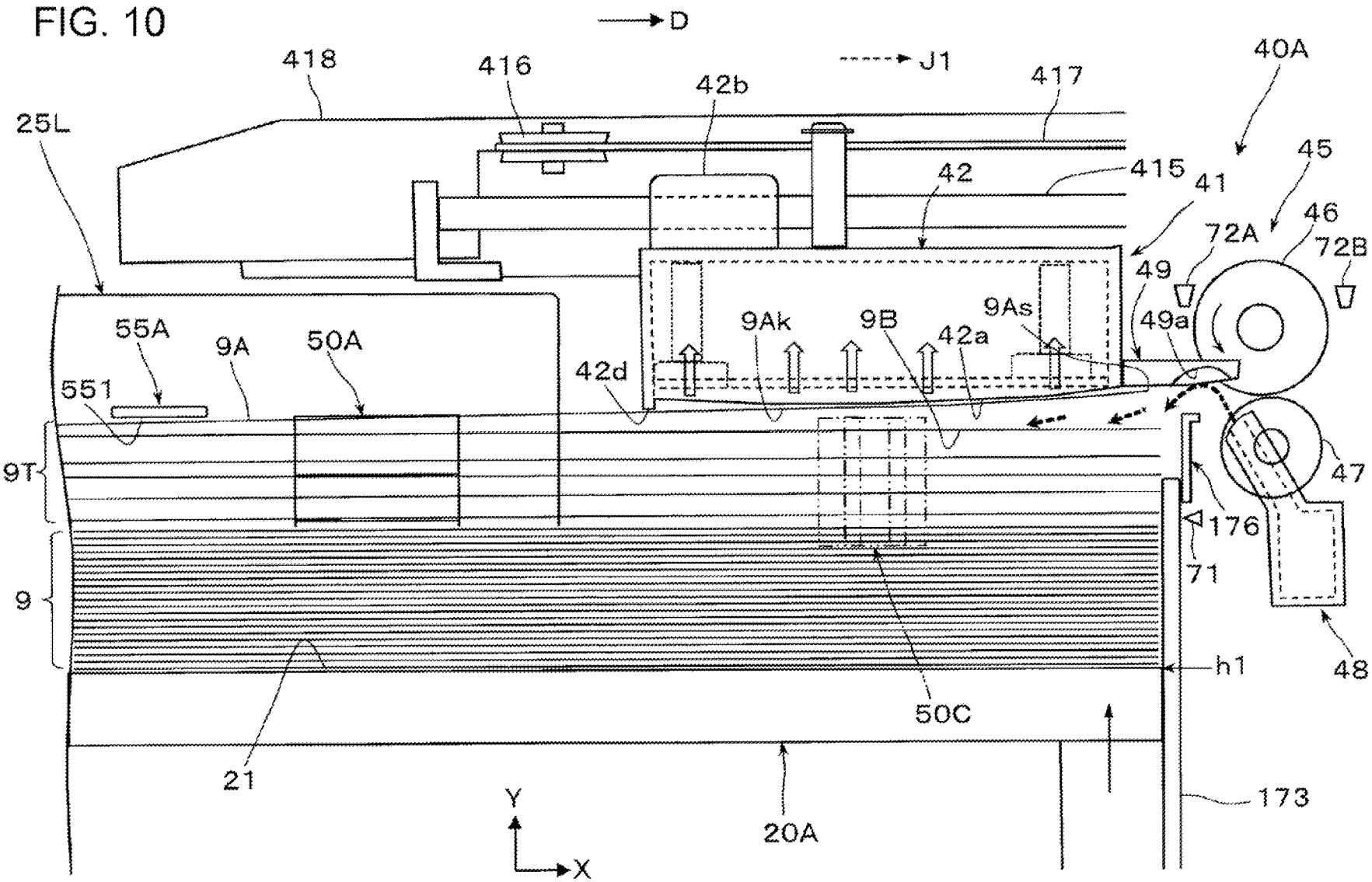
FIG. 10 is a schematic view of a feeder in an example state in a normal feeding operation.

Thus, multiple upper sheet-shaped media 9T at the mount portion 20A are raised to be spaced apart from each other in the vertical direction (refer to FIG. 10).

As illustrated in FIGS. 3 and 7 and other drawings, in the mount portion 20A, the side walls 25L and 25R each include multiple height limiters 55 on the contact surface 251. The height limiters 55 come into contact with the upper surfaces of the left and right edge portions of the sheet-shaped media 9 stacked on the mount portion 20A or 20B to limit the upper surfaces to a predetermined height.

As illustrated in FIGS. 3 and 4 and other drawings, the height limiters 55 in the left side wall 25L include one height limiter 55A disposed upstream from the air outlet 50A in the transportation direction D, and two height limiters 55B and 55C disposed on both sides of, that is, downstream and upstream from the air outlet 50B in the transportation direction D.

As illustrated in FIG. 4 and other drawings, the height limiters 55 in the right side wall 25R include one height limiter 55D disposed between the air outlet 50C and the air outlet 50D, and two height limiters 55E and 55F disposed downstream from the air outlet 50D in the transportation direction D.

As illustrated in FIG. 4 and other drawings, these height limiters 55A to 55F are formed from, for example, plate members protruding by a predetermined height from a predetermined height of the contact surfaces 251 of the side walls 25L and 25R over and above the mount surface 21 of the mount portion 20A or 20B.

As illustrated in, for example, FIGS. 6 and 7, contact surfaces 551 or lower surfaces of the height limiters 55A to 55F are located on the level the same as or higher than the level of a lowest portion 42*d* of a suction area VE, serving as a lowermost end of a frame 42 of the suction portion 41, described below. A two-dot chain line VL in FIG. 6 and other drawings is a virtual horizontal extension passing the lowest portion 42*d* of the frame 42.

During an operation of stacking the sheet-shaped media 9 on the mount surface 21 of the mount portion 20A or 20B (when the mount portion 20A or 20B is moved to the lowermost position), the height limiters 55A to 55F are, for example, retracted in the side walls 25L and 25R without protruding from the contact surfaces 251.

When, as described above, air is blown out through the air outlets 50 in the left and right edge air blowers to raise the multiple upper sheet-shaped media 9T, the height limiters 55A to 55F hold from above the left and right edge portions of the raised multiple upper sheet-shaped media 9T (actually, an uppermost sheet-shaped medium 9A).

Thus, over the mount portion 20A, the raised sheet-shaped media 9T are kept at a predetermined height from the mount surface 21 of the mount portion 20A.

As illustrated in FIGS. 4 to 6 and other drawings, the container 17A includes two stoppers 176 that prevent the raised sheet-shaped media 9T from accidentally moving in the transportation direction D to a position downstream from the recess 173*b* of the leading-end wall 173 in the transportation direction D. The stoppers 176 are, for example, plate-shaped members. The upper end of each stopper 176 is disposed inside the recess 173*b* of the leading-end wall 173 to protrude upward from the upper end of the leading-end wall 173 by a predetermined length.

As illustrated in FIGS. 2, 3, and 5 and other drawings, the dischargers 40A and 40B each include the suction portion 41, a transporter 45, a tip-end air blower, and a guide member, not illustrated. The suction portion 41 sucks the uppermost one of the sheet-shaped media 9 stacked on the mount portion 20A or 20B to carry the uppermost sheet-shaped medium 9A. The transporter 45 transports the sheet-shaped medium 9A sucked and transported by the suction portion 41. The tip-end air blower blows air to below the uppermost sheet-shaped medium 9A sucked by the suction portion 41. The guide member forms a first transport path Rh1, described below.

As illustrated in FIGS. 3 to 8 and other drawings, the suction portion 41 is disposed to oppose the mount surface 21 of the mount portion 20A or 20B at the downstream end portion of the container 17A or 17B in the transportation direction D and at an upper portion inward from the leading-end wall 173.

The suction portion 41 is formed as a suction head that includes a hollow cubic frame 42 with a lower surface open, a suction plate 43 including multiple inlet ports 43*a* arranged in a predetermined pattern, and multiple branched intake tubes 44*a* respectively connected to the multiple inlet ports 43*a*. The suction plate 43 is disposed slightly above and inward from the lower opening of the frame 42. The suction head is connected to a suction duct or pipe 44 connected to the multiple branched intake tubes 44*a*, and to a suction driving device 63 that sucks air through the suction duct or pipe 44.

This suction portion 41 operates the suction driving device 63 to cause suction force on the suction plate 43 of the suction head to suck the sheet-shaped medium 9 while bringing the sheet-shaped medium 9 into contact with a lowest portion 42*a* of the frame 42.

Thus, as illustrated in FIGS. 4 and 5, the suction portion 41 has a rectangular surface area surrounded by the lowest portion 42*a* of the frame 42 serving as a suction area VE. The suction area VE of the suction portion 41 according to the present exemplary embodiment has an area approximately opposing a portion of the mount surface 21 of each of the mount portions 20A and 20B located near the downstream end in the transportation direction D and substantially the center portion in the left and right directions L and R crossing the transportation direction D.

As illustrated in FIGS. 5, 6, and 7 and other drawings, the suction portion 41 is disposed upstream from the transporter 45 in the transportation direction D to move forward and rearward in a direction indicated with a broken double-pointed arrow toward the directions J1 and J2 parallel to the transportation direction D.

The suction portion 41 allows support portions 42*b* at upper portions of the frame 42 to be movably attached to two guide rails 415 disposed above the support portions 42*b* in parallel with the transportation direction D. The guide rails 415 are disposed on a support frame 418 fixed to an internal frame 19, or part of the housing 10.

The suction portion 41 has connection portions 42*c* at upper portions of the frame 42 fixed to part of a movable belt 417 wound around a pair of pulleys 416A and 416B above the guide rails 415. The pair of pulleys 416A and 416B are spaced apart from each other on the upstream and downstream sides in the transportation direction D. The movable belt 417 drives the suction portion 41 by a predetermined distance in a predetermined direction. As illustrated in FIG. 6, the pulley 416B is driven to rotate in a predetermined direction upon receipt of forward and reverse rotation power from a forward-rearward driving device 64 including, for example, a motor and a transmission.

During sucking the sheet-shaped medium 9, the suction portion 41 is stopped at a position (suction position) where the suction area VE faces the mount surface 21 of the mount portion 20A.

Subsequently, after finishing the suction, the suction portion 41 operates the forward-rearward driving device 64 to move the movable belt 417 to move forward toward the transporter 45 to a position (delivery position) where the transportation leading end 9*s* of the sucked uppermost sheet-shaped medium 9A is passed to the transporter 45. Subsequently, after finishing the delivery, the suction portion 41 operates the forward-rearward driving device 64 to move the movable belt 417 to move rearward from the delivery position to the suction position.

The transporter 45 is disposed outward from and downstream from the leading-end wall 173 of the container 17A or 17B in the transportation direction D, and downstream from the suction portion 41 in the transportation direction D.

As illustrated in FIGS. 5 and 6, the transporter 45 includes, for example, pairs of transport rollers, and a transport guide member not illustrated. Each pair of transport rollers include a driving transport roller 46 and a driven transport roller 47. The driving transport roller 46 includes a rotation shaft 461 and allows multiple transport rollers attached to the rotation shaft 461. The driven transport roller 47 is driven to rotate by coming into contact with a lower portion of the driving transport roller 46. The transport guide member defines a passage space of the first transport path Rh1.

As shown in FIG. 5, when viewed from the upstream side in the transportation direction D, the transport roller pairs of each including the driving transport roller 46 and the driven transport roller 47 are disposed to be within a range, in the lateral direction, of the recess 173*b* of the leading-end wall 173.

As illustrated in FIG. 8, each driving transport roller 46 is driven to rotate in a direction of arrow (refer to FIG. 6) during a discharging operation with rotation power transmitted to the rotation shaft 461 from a discharging driving apparatus 66 including, for example, a motor or a gear transmission mechanism.

An introduction guide member 452 illustrated in FIG. 5 guides the transportation leading end 9*s* of each of the sheet-shaped media 9 sucked and transported by the suction portion 41 into a portion between rollers of the transporter 45 (contact portions each between the driving transport roller 46 and the driven transport roller 47).

The transporter 45 starts rotating upon receipt of detection information from a front position sensor 72A that detects passage of the transportation leading end 9*s* of the sheet-shaped medium 9 sucked by the suction portion 41 and on the way to be transported to the transporter 45. The transporter 45 stops rotating upon receipt of detection information from a rear position sensor 72B that detects passage of the transportation trailing end of the sheet-shaped medium 9 fed from the transporter 45. Instead, the transporter 45 may keep rotating during the feeding operation of the sheet-shaped media.

As illustrated in FIG. 6 or 8, the front position sensor 72A is disposed closer to and upstream, in the transportation direction D, from the pairs of transport rollers each including the driving transport roller 46 and the driven transport roller 47. The rear position sensor 72B is disposed closer to and downstream, in the transportation direction D, from the pairs of transport rollers each including the driving transport roller 46 and the driven transport roller 47. The front position sensor 72A and the rear position sensor 72B are, for example, optical non-contact sensors.

As illustrated in FIGS. 4 to 6 and 8, the tip-end air blower includes an air nozzle 48 including an outlet port 48*a* through which air is blown out, and an air guide board 49 that guides the air blown out from the outlet port 48*a* in a predetermined direction.

The air nozzle 48 is disposed at a position downstream, in the transportation direction D, from the leading-end wall 173 and a transportation leading end 9As of the uppermost sheet-shaped medium 9A sucked by the suction portion 41. The air nozzle 48 is disposed to have its outlet port 48*a* facing the upstream side in the transportation direction D through a gap between the driving transport roller 46 and the driven transport roller 47, or each pair of transport rollers of the transporter 45 to blow air from the outlet port 48*a* obliquely upward with respect to the transportation direction D.

As illustrated in FIGS. 6 and 8, the air nozzle 48 has an airway 48*b*, continuous with the outlet port 48*a*, connected to a tip-end air blowing device 65 that feeds blowing air via a blast duct not illustrated.

As illustrated in FIG. 6, the air guide board 49 is a plate-shaped member having a lower surface with a concave guide recess 49*a* set back upward. As illustrated with a broken curved bold arrow in FIG. 10 by way of example, the guide recess 49*a* guides air blown out from the outlet port 48*a* of the air nozzle 48 to below the uppermost sheet-shaped medium 9A sucked by the suction portion 41. The air guide board 49 is attached to the downstream side portion of the frame 42 of the suction portion 41 in the transportation direction D. Thus, the air guide board 49 moves with forward or reverse movement of the suction portion 41.

The air nozzle 48 of the tip-end air blower starts and stops blowing air at predetermined timing, for example, after activation of the tip-end air blowing device 65 upon receipt of information of starting the suction operation of the suction portion 41.

As illustrated in FIGS. 2 and 3, the discharge portion 14 includes the first transport path Rh1, and a second transport path Rh2. Along the first transport path Rh1, the sheet-shaped media 9 are transported to the outside by the discharger 40A from the feed unit 12 on the upper side. Along the second transport path Rh2, the sheet-shaped media 9 are transported to the outside by the discharger 40B from the feed unit 13 on the lower side.

The first transport path Rh1 and the second transport path Rh2 are discharge transport paths extending up to discharge rollers 142 at a discharge port 18 in a side portion 10B of the housing 10 while merging midway. The first transport path Rh1 and the second transport path Rh2 each include pairs of transport rollers, drawn with broken lines, and a transport guide member not illustrated.

Figure 9:
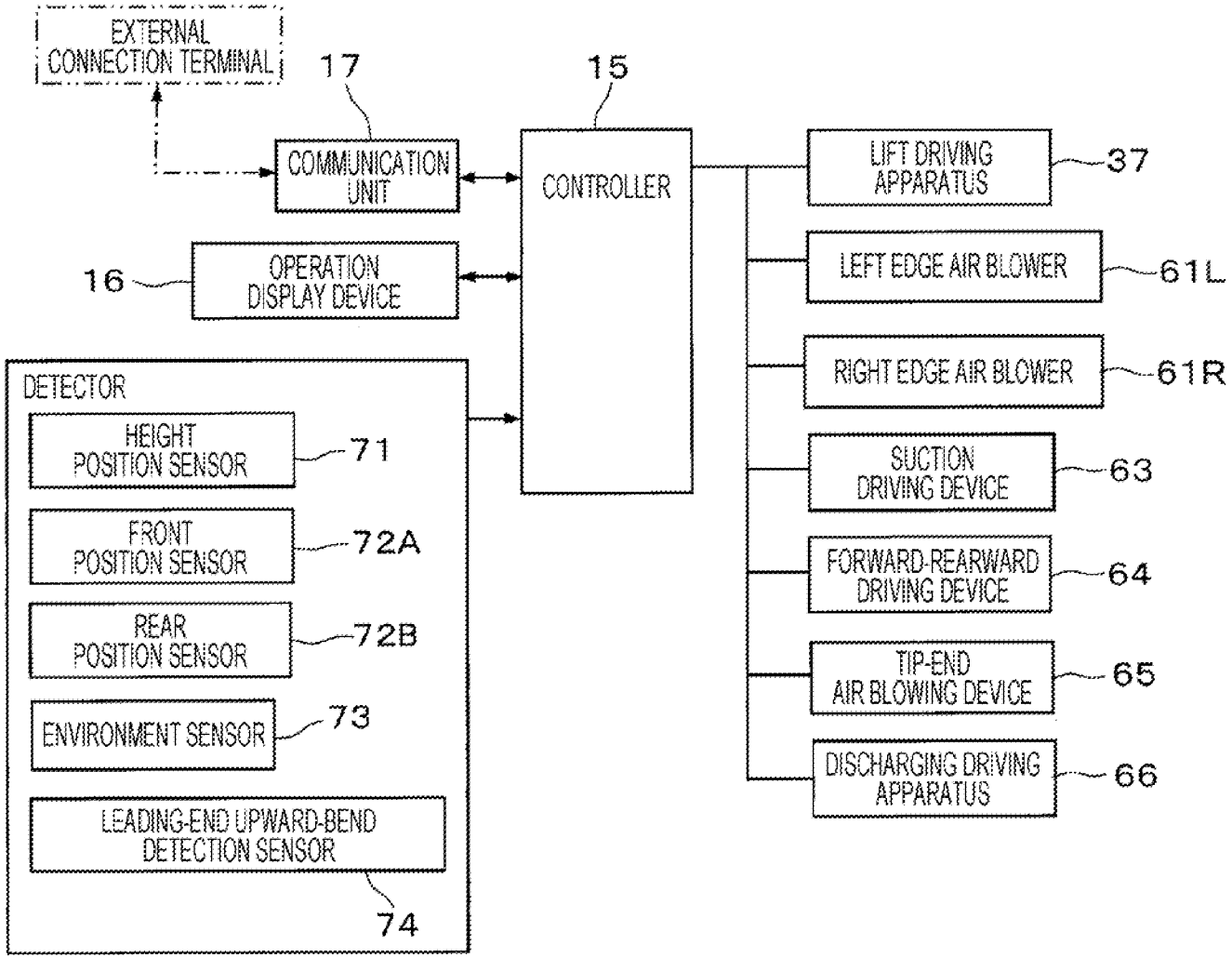
FIG. 9 is a schematic structure diagram of a control system of the feeder.

As illustrated in FIGS. 3 and 9, the feeder 1 includes a controller 15 that controls the feeder 1. The controller 15 includes, for example, a central processing unit (CPU), a read-only memory (ROM), a random access memory (RAM), and an input-output device. Instead of included in the feeder 1, the controller 15 may be included in the image forming system 100A that includes the feeder 1, or may be formed as part of a controller in the image forming system 100A.

The controller 15 is connected to, for example, an operation display device 16, a communication unit 17, and detectors including various sensors to obtain information used for control. The operation display device 16 includes, for example, an operation key and a liquid crystal panel that displays various information relating to, for example, inputs of operational settings or operation states. The communication unit 17 communicates with an external connection terminal used while being connected to, for example, the image forming system 100A. Examples of the detectors include the height position sensor 71, the front position sensor 72A, the rear position sensor 72B, and an environment sensor 73 that detects the environmental conditions such as the temperature or humidity in the housing 10 of the feeder 1.

The controller 15 is also connected to driving control circuits in the lift driving apparatus 37 in the lift 30, in left and right edge air blowing devices 61L and 61R in the left and right edge air blowers, in the suction driving device 63 and the forward-rearward driving device 64 in the suction portion 41, in the tip-end air blowing device 65 in the tip-end air blower, and in the discharging driving apparatus 66 in the transporter 45 to control these components.

The controller 15 performs calculation in accordance with various programs or data prestored in a read-only memory while the central processing unit captures input setting information of the operation display device 16 or various detection information from the detectors to operate a control target to transmit desired control signals.

The controller 15 also performs overlap-transport prevention control, described below.

Operation of Feeding Sheet-Shaped Media

The operation of the sheet-shaped-medium feeder 1 feeding the sheet-shaped media 9 will be described now.

When the controller 15 receives a command of the feeding operation from an external connection terminal or the image forming system 100A, the feeder 1 confirms that the predetermined sheet-shaped media 9 are accommodated in the feed units 12 and 13, and then performs a series of the feeding operation. Here, the feeding operation will be described using the feed unit 12 on the upper side as an example.

Firstly, in the feed unit 12 on the upper side, the lift 30 starts raising the mount portion 20A. Thus, as illustrated in FIG. 10 by way of example, the mount portion 20A in the container 17A is raised until the uppermost one of the sheet-shaped media 9 stacked on the mount surface 21 of the mount portion 20A arrives at a predetermined ready-to-feed height with reference to the detection information from the height position sensor 71. Here, the mount portion 20A stops after the mount surface 21 is raised to a height position h1 corresponding to the ready-to-feed height.

Subsequently, after the mount portion 20A is completely raised to the ready-to-feed height, the left and right edge air blowing devices 61L and 61R in the left and right edge air blowers in the left and right side walls 25L and 25R are activated to start raising the sheet-shaped media 9, and the suction driving device 63 in the suction portion 41 in the discharger 40A is activated to start the sucking operation.

Here, on the mount portion 20A, air is blown at a predetermined flow rate through the air outlets 50A, 50B, 50C, and 50D in the left and right side walls 25L and 25R against the left and right edge portions of the upper sheet-shaped media 9T of the sheet-shaped media 9 stacked on the mount surface 21. Thus, as illustrated in FIG. 10 by way of example, the upper sheet-shaped media 9T are raised upward with air flowing in through the left and right edge portions to be vertically separated from each other.

Here, the upper surfaces of the left and right edge portions of the uppermost sheet-shaped medium 9A of the multiple raised sheet-shaped media 9T are prevented from being raised further while coming into contact with the contact surfaces 551 of the height limiters 55A to 55F, and have their height restricted at the height substantially the same as the height of the lowest portion 42*d* in the suction area VE.

Here, over the mount portion 20A, predetermined suction force (solid-white arrow) is caused at the suction plate 43 of the suction portion 41 that is stationary in the suction position where the suction operation is performed.

Thus, as illustrated in FIG. 10 by way of example, a leading-end portion 9Ak, in the transportation direction D, of the uppermost sheet-shaped medium 9A in the multiple raised sheet-shaped media 9T is sucked by the suction area VE having a negative pressure and surrounded by the lower end of the frame 42 in the suction portion 41.

The uppermost sheet-shaped medium 9A here is sucked after being slightly raised toward the suction portion 41. Thus, as illustrated in FIG. 10, the uppermost sheet-shaped medium 9A has a gap between itself and a second uppermost sheet-shaped medium 9B below.

The transportation leading end 9As of the sucked uppermost sheet-shaped medium 9A does not face the suction area VE, and is thus left free while being located close to a mount base of the lower surface of the air guide board 49 attached to the frame 42 at a position out of and downstream from the suction area VE in the transportation direction D.

Subsequently, after the uppermost sheet-shaped medium 9A is completely sucked by the suction portion 41, the tip-end air blowing device 65 in the tip-end air blower is activated to start separating the sucked uppermost sheet-shaped medium 9A from the other sheet-shaped media 9, and the forward-rearward driving device 64 in the suction portion 41 is activated to start moving forward toward the transporter 45 of the suction portion 41.

Here, in the tip-end air blower, as illustrated with broken bold arrows in FIG. 10 by way of example, predetermined air is blown from the outlet port 48*a* of the air nozzle 48 obliquely upward toward the upstream side in the transportation direction D, and the air is guided by the guide recess 49*a* of the air guide board 49 to be fed toward the space below the uppermost sheet-shaped medium 9A sucked by the suction portion 41.

The air is thus blown into the space between the sucked uppermost sheet-shaped medium 9A and the second uppermost sheet-shaped medium 9B. Thus, the second uppermost sheet-shaped medium 9B is spaced apart downward from the uppermost sheet-shaped medium 9A.

Here, the suction portion 41 of the discharger 40A moves forward from the suction position to the delivery position. Thus, the uppermost sheet-shaped medium 9A sucked by the suction portion 41 moves toward the transporter 45 on the downstream side in the transport direction D and is passed to the transporter 45. Specifically, the leading end 9As of the sheet-shaped medium 9A sucked and transported by the suction portion 41 is introduced into the contact portions each between the driving transport roller 46 and the driven transport roller 47, which are a pair of rollers in the transporter 45.

Here, when the front position sensor 72A detects passage of the leading end 9As of the to-be-delivered uppermost sheet-shaped medium 9A, in the transporter 45 in the discharger 40A, the discharging driving apparatus 66 is activated and starts discharging the sheet-shaped medium 9.

Thus, the uppermost sheet-shaped medium 9A passed from the suction portion 41 is held between each pair of the driving transport roller 46 and the driven transport roller 47 in the transporter 45 to be transported, discharged from the mount portion 20A and the container 17A, and fed to the first transport path Rh1.

Here, the discharged sheet-shaped medium 9A moves in the transportation direction D while having the left and right edge portions coming into contact with and being guided by the contact surfaces 251 of the left and right side walls 25L and 25R. Thus, the discharged sheet-shaped medium 9A is discharged while having a normal orientation without being inclined.

After the leading end 9*s* of the uppermost sheet-shaped medium 9A is introduced between the driving transport roller 46 and the driven transport roller 47 in the transporter 45, the suction driving device 63 in the suction portion 41 stops operating to finish the suction operation.

When the rear position sensor 72B detects passage of the trailing end of the transported uppermost sheet-shaped medium 9A, the transporter 45 stops the operation of the discharging driving apparatus 66 to finish the discharging operation. When the rear position sensor 72B detects passage of the trailing end of the transported uppermost sheet-shaped medium 9A, the suction portion 41 moves rearward to be returned from the delivery position to the suction position.

Thus, after the uppermost sheet-shaped medium 9A is discharged from the feed unit 12 on the upper side through the discharge port 18 via the first transport path Rh1, the sheet-shaped medium 9A is fed to the image forming apparatus 120A (the first introduction transport path Rt1 of the image forming apparatus 120A), serving as an example of a destination.

In the feeder 1, in substantially the same manner as in the feeding operation of the feed unit 12 on the upper side, the sheet-shaped media 9 stacked on the mount portion 20B are also discharged from the feed unit 13 on the lower side through the discharge port 18 via the second transport path Rh2, and then the sheet-shaped media 9 are fed to the destination.

In the image forming system 100A, when the sheet-shaped media 9 are fed from the feeder 1 to the image forming apparatus 120A serving as an example of the processing device 120, images are formed on the sheet-shaped media 9.

Figure 15:
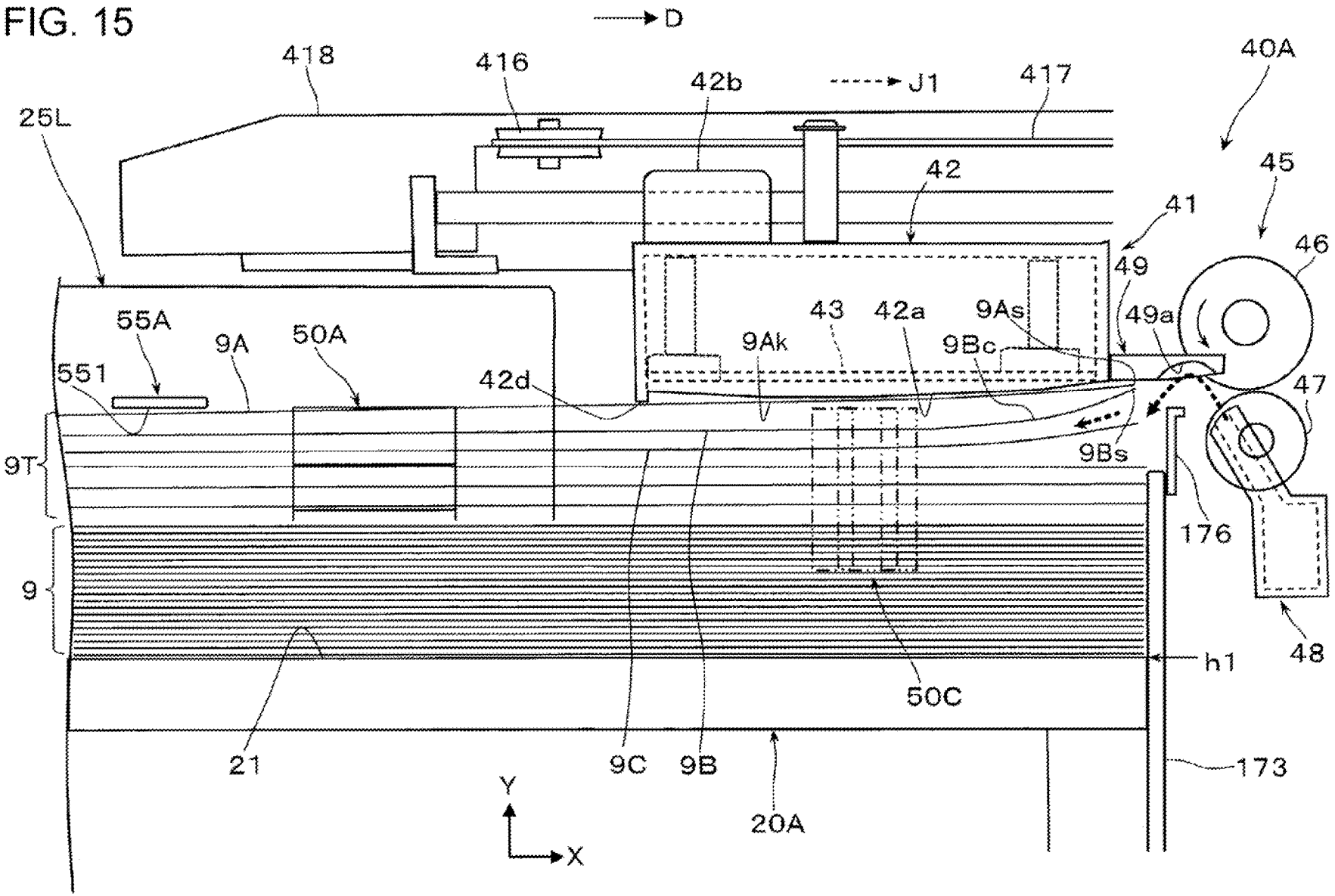
FIG. 15 is a schematic diagram of an example state when an overlap transport occurs in the feeder.

However, as illustrated in FIG. 15, when, in the feeder 1, transportation leading ends 9*s* of some of the sheet-shaped media 9 stacked on the mount surface 21 of the mount portion 20A or 20B are bent upward and the upwardly bent sheet-shaped media 9 are included in the second uppermost and lower sheet-shaped media 9 including a second uppermost sheet-shaped medium 9B, the uppermost sheet-shaped medium 9A sucked by the suction portion 41 may be transported while being overlapped with at least the bent second uppermost sheet-shaped medium 9B.

More specifically, when the lower sheet-shaped media 9 including the second uppermost sheet-shaped medium 9B include at least one upwardly bent sheet-shaped medium 9, as illustrated in FIG. 15, for example, a transportation leading end 9Bs of an upwardly bent leading-end portion 9Bc in the second uppermost sheet-shaped medium 9B moves toward the leading end 9As of the sucked uppermost sheet-shaped medium 9A, so that a gap therebetween is reduced.

Thus, as indicated with broken bold arrows in FIG. 15 by way of example, air blown from the air nozzle 48 in the tip-end air blower fails to flow between the leading end 9As of the sucked uppermost sheet-shaped medium 9A and the leading end 9Bs of the second uppermost sheet-shaped medium 9B, and is more likely to flow between, for example, the second uppermost sheet-shaped medium 9B and a third uppermost sheet-shaped medium 9C.

Thus, the second uppermost sheet-shaped medium 9B is raised by air to move toward the uppermost sheet-shaped medium 9A without being sufficiently spaced apart from the uppermost sheet-shaped medium 9A. Thus, when the suction portion 41 moves forward from the suction position to the delivery position, the second uppermost sheet-shaped medium 9B is transported and passed to the transporter 45 together with the uppermost sheet-shaped medium 9A to cause an overlap transport.

Other Structure of Feeder

Figure 11:
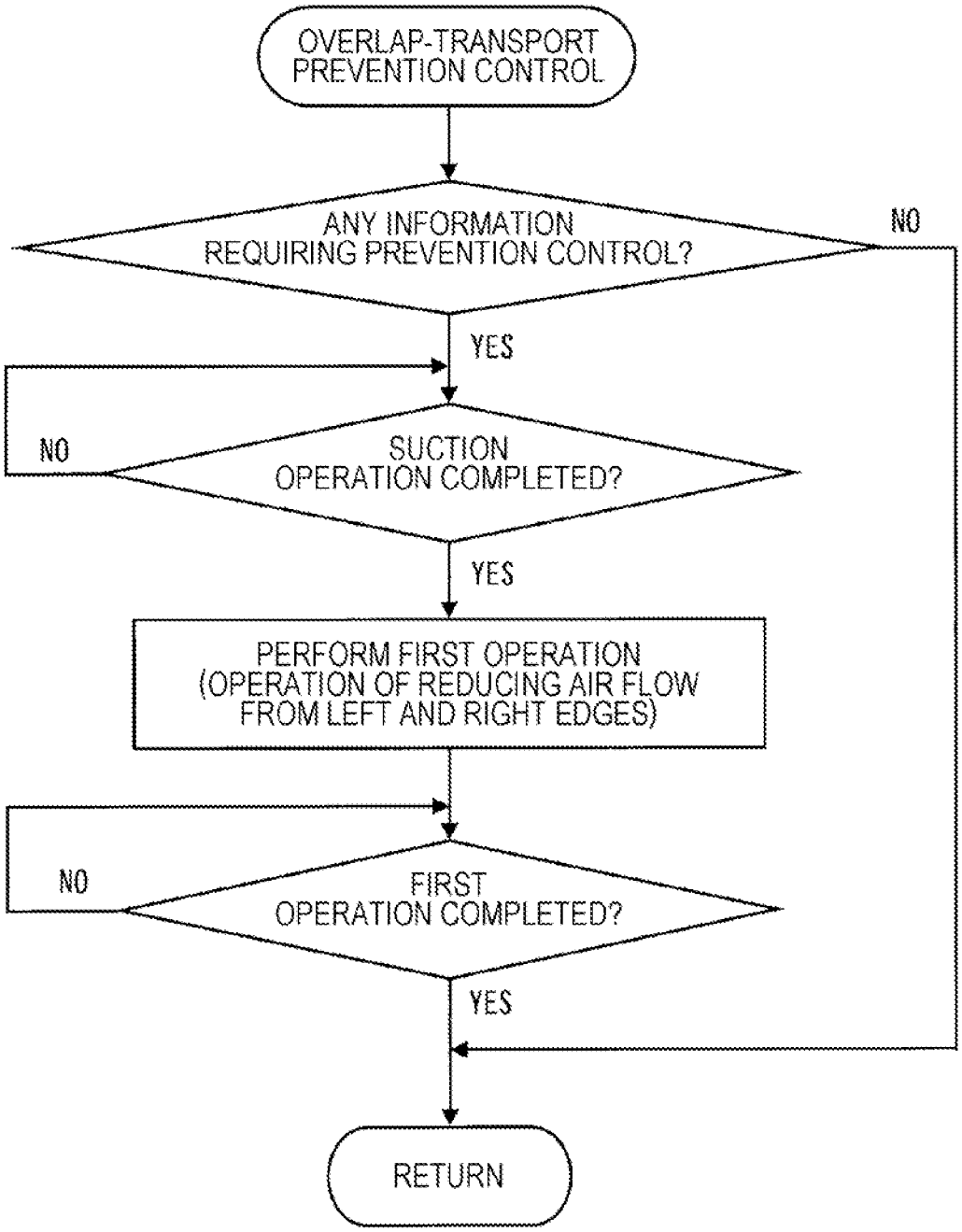
FIG. 11 is a flowchart of overlap-transport prevention control performed by the feeder.

As illustrated in FIG. 11, when the uppermost sheet-shaped medium 9A is sucked by the suction portion 41 in the feeding operation, the feeder 1 performs a first operation of spacing the upwardly bent transportation leading-end portion 9Bc of the second uppermost sheet-shaped medium 9B apart downward from the sucked uppermost sheet-shaped medium 9A.

The first operation is a control operation of preventing an overlap transport. As an example of the first operation, the exemplary embodiment employs an operation (second operation) of reducing the air flow from the left and right edge air blowers further than in a normal operation when the uppermost sheet-shaped medium 9A is sucked by the suction portion 41.

Here, the air flow in a normal operation is an air flow at a flow rate or speed for raising upper sheet-shaped media 9T when a suction operation in the feeding operation is performed.

To reduce the air flow from the edge air blowers further than in a normal operation is to reduce the degree by which the upper sheet-shaped media 9T are raised during the suction operation.

Here, the flow rate is reduced to such a level of wind power (flow rate or speed) allowing the second uppermost sheet-shaped medium 9B having the upwardly bent leading-end portion 9Bc to be lowered to form a gap between the leading end 9As of the uppermost sheet-shaped medium 9A and the leading end 9Bs of the second uppermost sheet-shaped medium 9B into which air is blown from the air nozzle 48 in the tip-end air blower via the air guide board 49.

The degree by which the air flow from the edge air blowers is reduced further than in the normal operation may be set with reference to the wind power level of air flow that allows the leading end 9Bs of the second uppermost sheet-shaped medium 9B with the upwardly bent leading-end portion 9Bc to be lowered to below a height hx of upper ends 176*t* (refer to FIG. 6) of the stoppers 176 in view of, for example, smooth flow of air blown from the tip-end air blower.

The operation of reducing the air flow from the edge air blowers is performed by reducing the driving rates of the left and right edge air blowing devices 61L and 61R in the left and right edge air blowers or by reducing the degree of opening of the open-close valves.

The overlap-transport prevention control involving the first operation is performed when needed.

Examples of information requiring the prevention control include information that informs that the leading-end portions 9*k* of any of the stacked sheet-shaped media 9 is bent upward.

Examples usable as information requiring the overlap-transport prevention control include detection information obtained from a leading-end upward-bend detection sensor 74 (refer to FIG. 9) that detects that the leading-end portion of any of the stacked sheet-shaped media 9 is bent upward. The leading-end upward-bend detection sensor 74 includes, for example, multiple sensors (including a positional change sensor) capable of detecting the distance from up to down around the suction portion 41, more specifically, the distance from itself to the uppermost sheet-shaped medium 9A.

When detection information from the leading-end upward-bend detection sensor 74 is used, detection information that the leading-end portion 9Bc of the second uppermost sheet-shaped medium 9B is bent upward is used as an example of information requiring the prevention control. As illustrated in FIG. 9, the leading-end upward-bend detection sensor 74 is connected to the controller 15 as part of a detector.

The overlap-transport prevention control involving the first operation is performed as one of control operations performed by the controller 15.

As illustrated in FIG. 11, while the feeder 1 performs the feeding operation, the controller 15 determines whether there is any information requiring the prevention control, and performs, when obtaining the information requiring the prevention control, a control to perform the first operation after obtaining information that the suction operation of sucking the uppermost sheet-shaped medium 9A with the suction portion 41 is completed. The controller 15 finishes the first operation when, for example, obtaining, based on the detection information from the leading-end upward-bend detection sensor 74, information that the leading-end portions of the sheet-shaped media 9 are not bent upward. Then, the controller 15 returns to the state before the first operation is performed.

Programs or data for performing the overlap-transport prevention control are stored in advance in a read-only memory.

Overlap-Transport Prevention Control

When the feeder 1 capable of performing the overlap-transport prevention control performs the operation of feeding the sheet-shaped medium 9, as illustrated in FIG. 11, the controller 15 determines whether there is any information requiring the overlap-transport prevention control.

When the controller 15 obtains, as information requiring the overlap-transport prevention control, information that the leading-end upward-bend detection sensor 74 detects that the leading-end portion 9Bc of the second uppermost sheet-shaped medium 9B is bent upward, the feeder 1 performs the first operation.

The first operation here is started when the controller 15 obtains information that the operation of the suction portion 41 sucking the uppermost sheet-shaped medium 9A is completed. The first operation is an operation (second operation) of reducing the air flow from the left and right edge air blowers further than in the normal operation. Thus, the controller 15 performs a control of reducing the degree of opening of the open-close valves for blast ducts installed together with the left and right edge air blowing devices 61L and 61R in the left and right edge air blowers, or a control of reducing outputs from the edge air blowing devices 61L and 61R.

Thus, in the state where the uppermost sheet-shaped medium 9A is sucked by the suction portion 41, the feeder 1 reduces the air flow from the air outlets 50 of the left and right edge air blowers.

Figure 12:
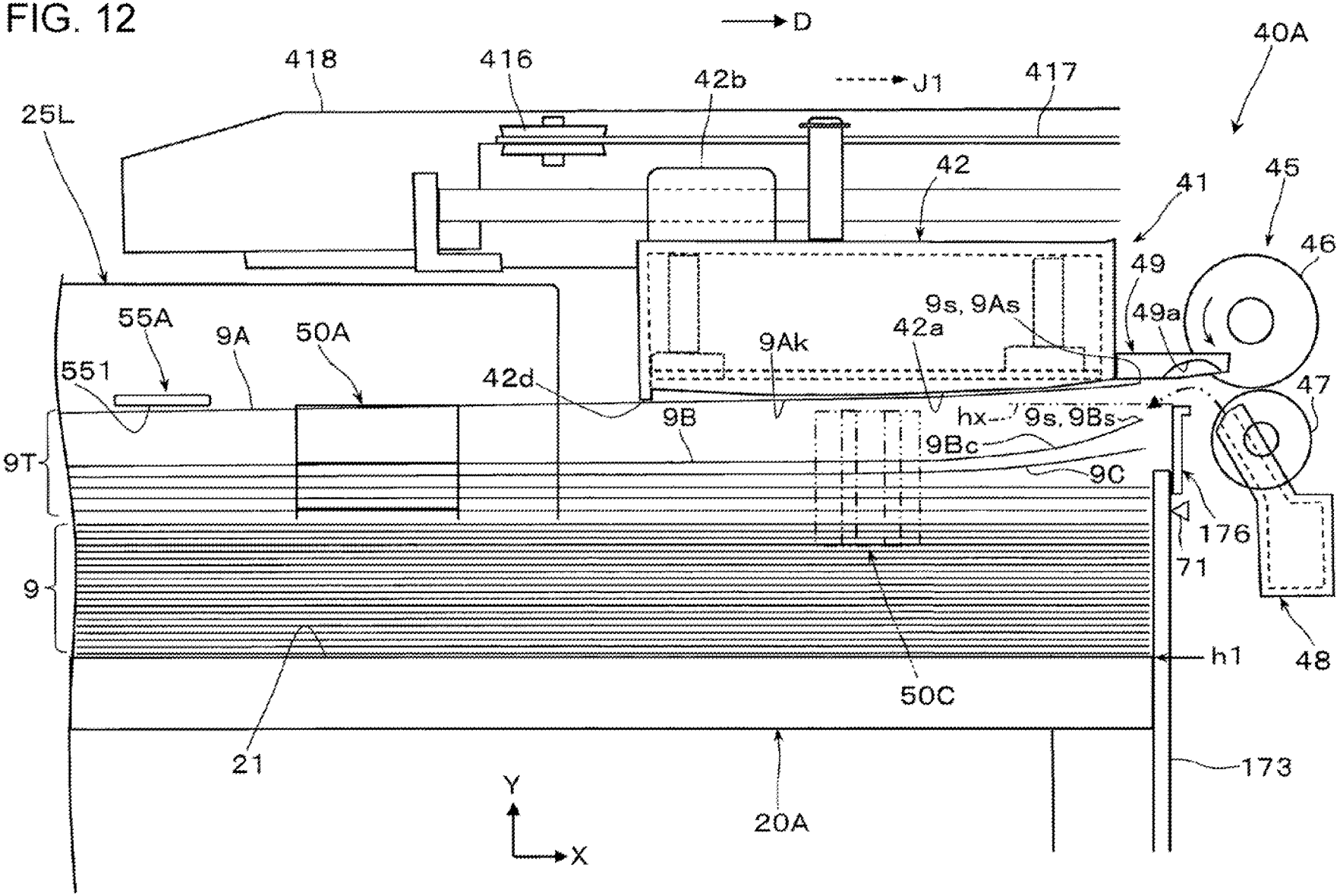
FIG. 12 is a schematic diagram of an example state of a feeding operation when the overlap-transport prevention control in FIG. 11 is performed.

In the feeder 1, the multiple sheet-shaped media 9T (refer to FIG. 15) that have been raised thus far over the mount portion 20A are slightly lowered with reduction of the raising effect as illustrated in FIG. 12 by way of example. Here, although the entirety of the second uppermost sheet-shaped medium 9B is lowered, the upwardly bent leading-end portion 9Bc is particularly spaced apart downward from the uppermost sheet-shaped medium 9A sucked by the suction portion 41.

Thus, as illustrated in FIG. 12, a gap is secured between the leading end 9As of the sucked uppermost sheet-shaped medium 9A and the leading end 9Bs of the second uppermost sheet-shaped medium 9B. When the second uppermost sheet-shaped medium 9B is lowered to a position where the leading end 9Bs is lowered to a position below the upper ends 176*t* of the stoppers 176, the gap between the leading end 9Bs and the leading end 9As of the uppermost sheet-shaped medium 9A is more reliably secured.

The first operation here is finished when the controller 15 obtains, for example, information that the leading-end portions of the sheet-shaped media 9 are determined as not being bent upward based on the detection information from the leading-end upward-bend detection sensor 74.

When the first operation is finished, the feeder 1 blows air from the air nozzle 48 in the tip-end air blower.

Here, as indicated with an arrow of a two-dot chain line in FIG. 12, air from the air nozzle 48 is blown between the uppermost sheet-shaped medium 9A and the second uppermost sheet-shaped medium 9B. Thus, the second uppermost sheet-shaped medium 9B is fully separated from the uppermost sheet-shaped medium 9A with an air inflow.

When the suction portion 41 moves forward toward the transporter 45 to pass the sucked uppermost sheet-shaped medium 9A to the transporter 45, the second uppermost sheet-shaped medium 9B is prevented from being transported and passed to the transporter 45 together with the uppermost sheet-shaped medium 9A.

Thus, in the feeder 1, when the sheet-shaped media 9 stacked on the mount surface 21 of the mount portion 20A include the second uppermost sheet-shaped medium 9B with the transportation leading-end portion 9Bc bent upward, the second uppermost sheet-shaped medium 9B is prevented from being passed to the transporter 45 together with the uppermost sheet-shaped medium 9A or from being transported in an overlapped manner.

The feeder 1 performs an operation (second operation) of reducing the air flow from the left and right edge air blowers further than in the normal operation as an example of the first operation. This operation merely involves reduction of the air flow further than in the normal operation unlike in another example of the first operation. This operation thus simply allows the upwardly bent leading-end portion 9Bc of the second uppermost sheet-shaped medium 9B to be spaced apart downward from the uppermost sheet-shaped medium 9A sucked by the suction portion 41 while preventing reduction of the efficiency of feeding the sheet-shaped media 9.

The feeder 1 starts the first operation when the leading-end upward-bend detection sensor 74 detects that the leading-end portion 9Bc of the second uppermost sheet-shaped medium 9B is bent upward. Compared to the case where the first operation is not performed when such detection information is obtained, the first operation performed when an overlap transport of the sheet-shaped media 9 is more likely to occur prevents occurrence of an overlap transport as appropriate.

Second Exemplary Embodiment

Figure 13:
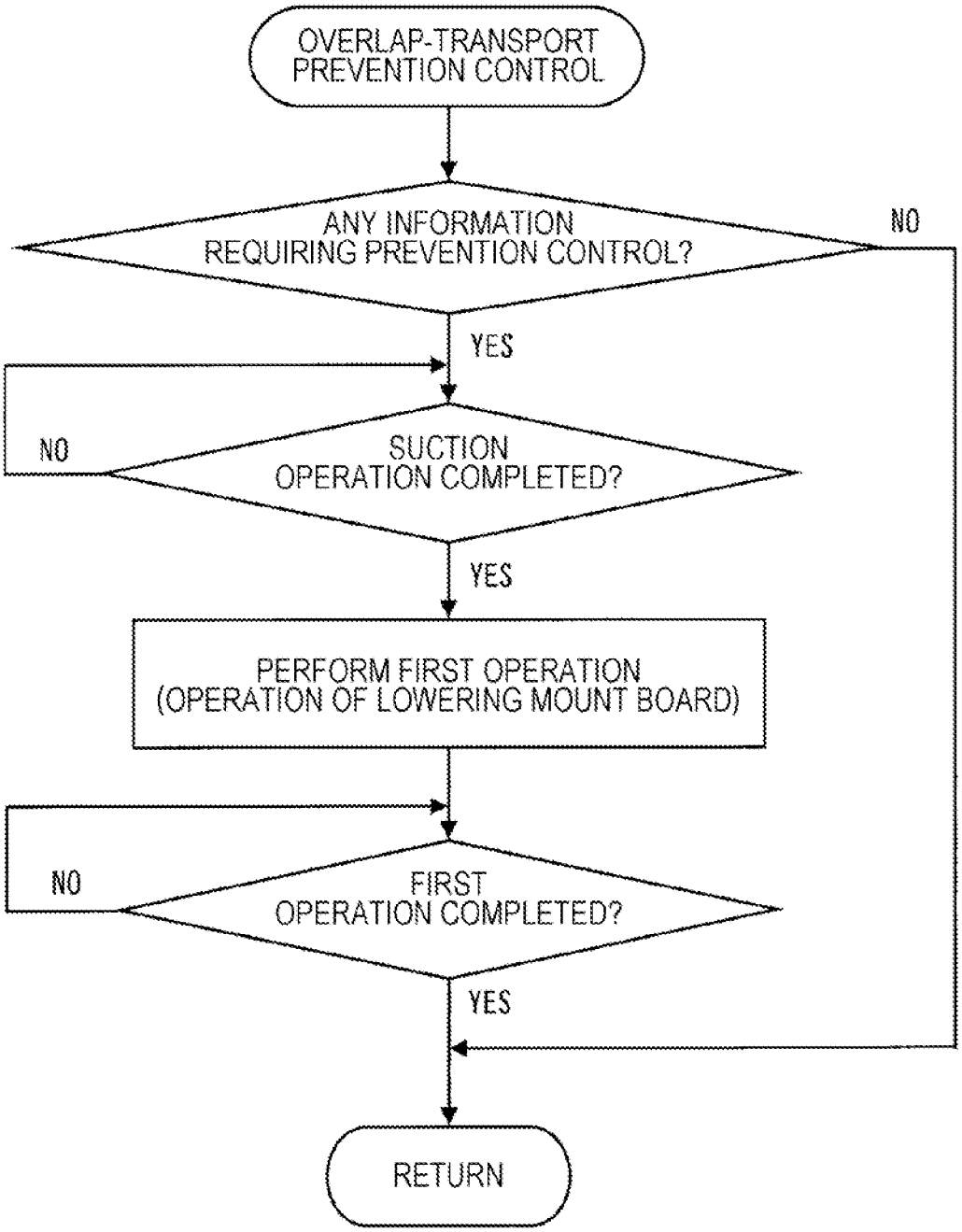
FIG. 13 is a flowchart of overlap-transport prevention control performed by a feeder according to a second exemplary embodiment.

FIG. 13 illustrates a portion (structure relating to overlap-transport prevention control) of a sheet-shaped-medium feeder 1 according to a second exemplary embodiment.

The feeder 1 according to the second exemplary embodiment and the feeder 1 according to the first exemplary embodiment have the same structure except that the first operation in the overlap-transport prevention control is changed. Thus, in the following description and the drawings, the same components are denoted with reference signs the same as those in the first exemplary embodiment without description otherwise needed.

In the overlap-transport prevention control according to the second exemplary embodiment, an operation (third operation) of lowering the mount portion 20A or 20B serving as an example of a mount board to a position below the normal position when the uppermost sheet-shaped medium 9A is sucked by the suction portion 41 is employed as an example of the first operation.

The normal position here is a height position h1 of the mount surface 21 where the mount portion 20A or 20B is raised and stopped to perform the suction operation in the feeding operation.

Here, the mount portion 20A or 20B is lowered below the normal position to a position where the mount surface 21 is located at a height position (h2) where the second uppermost sheet-shaped medium 9B with the upwardly bent leading-end portion 9Bc is lowered to form a gap that allows air blown from the air nozzle 48 in the tip-end air blower via the air guide board 49 between the leading end 9As of the uppermost sheet-shaped medium 9A and the leading end 9Bs of the second uppermost sheet-shaped medium 9B.

As in the case of reducing the air flow in the first exemplary embodiment, the degree by which the mount portion 20A or 20B is lowered below the normal position may be set so that the mount surface 21 is at a height position where the leading end 9Bs of the second uppermost sheet-shaped medium 9B with the upwardly bent leading-end portion 9Bc is lowered to a position below the height hx of the upper ends 176*t* (refer to FIG. 6) of the stoppers 176.

Here, the operation of lowering the mount portion 20A or 20B is performed by the lift driving apparatus 37 in the lift 30 lowering the mount board by a predetermined amount.

Other structures relating to the overlap-transport prevention control involving the first operation including the third operation are substantially the same as the structures of the overlap-transport prevention control according to the first exemplary embodiment.

Overlap-Transport Prevention Control

When the feeder 1 according to the second exemplary embodiment performs the operation of feeding the sheet-shaped media 9, as illustrated in FIG. 13, the controller 15 determines whether there is any information requiring the overlap-transport prevention control, and the first operation is performed when the information is obtained.

The first operation here is an operation (third operation) of lowering the mount portion 20A or 20B to a position below the normal position. Thus, the first operation is performed by the controller 15 as a control of operating the lift driving apparatus 37 to lower the mount portion 20A or 20B until the mount surface 21 is lowered to the predetermined height position h2.

Thus, in the feeder 1, while the uppermost sheet-shaped medium 9A is sucked by the suction portion 41, the mount portion 20A is lowered and stopped at the predetermined height position h2.

Figure 14:
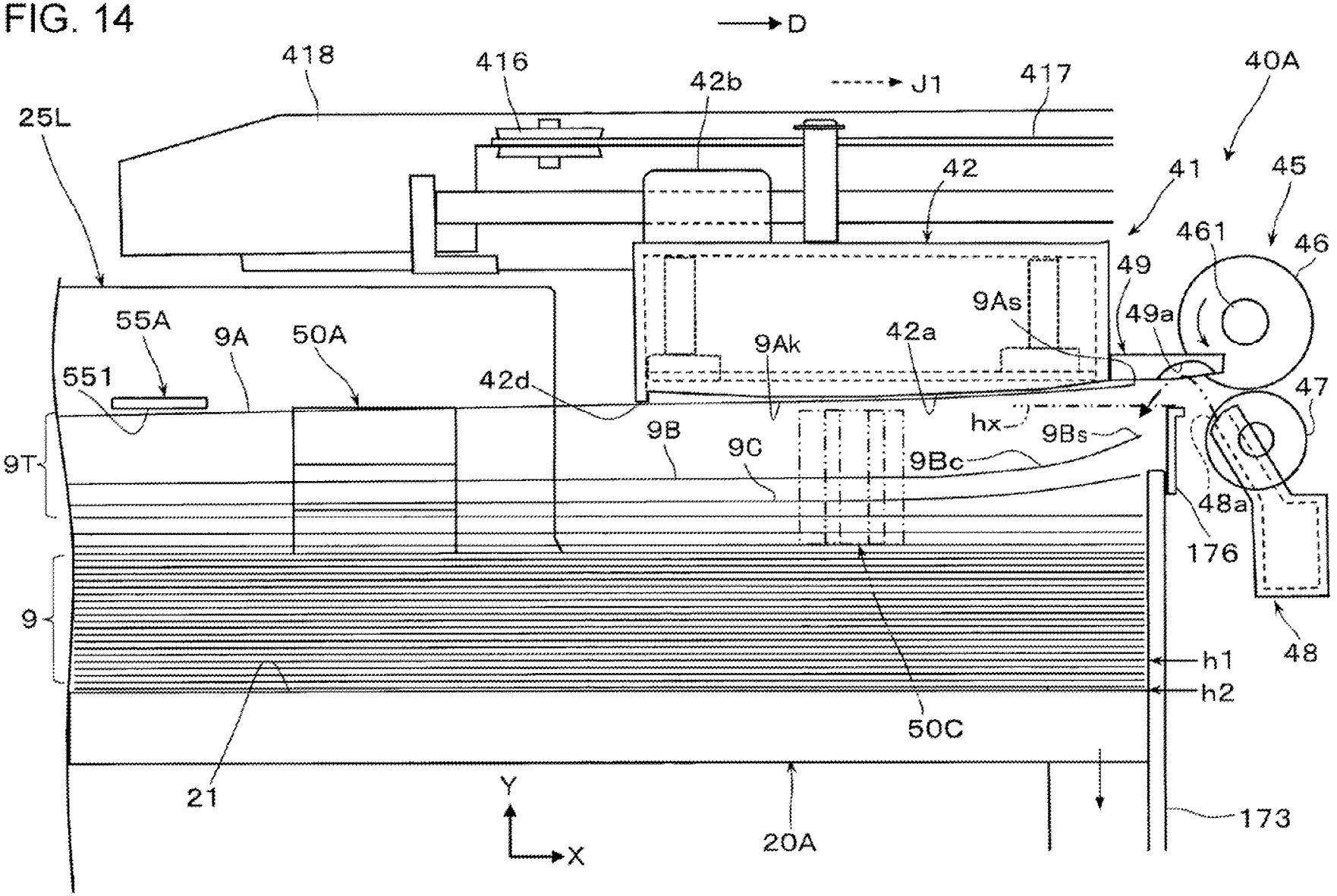
FIG. 14 is a schematic diagram of an example state of a feeding operation when the overlap-transport prevention control in FIG. 13 is performed.

Thus, in the feeder 1, the multiple sheet-shaped media 9T (refer to FIG. 15) that have been raised over the mount portion 20A are slightly lowered with lowering of the mount portion 20A, as illustrated in FIG. 14. Here, air normally flows from the air outlets 50 of the edge air blowers. Thus, the raised upper sheet-shaped media 9T are not lowered to a position to overlap the sheet-shaped media 9 remaining on the lowered mount surface 21. Also in this case, the entirety of the second uppermost sheet-shaped medium 9B is lowered, and the upwardly bent leading-end portion 9Bc is particularly spaced apart downward from the uppermost sheet-shaped medium 9A sucked by the suction portion 41.

Thus, as illustrated in FIG. 14, a gap is secured between the leading end 9As of the sucked uppermost sheet-shaped medium 9A and the leading end 9Bs of the second uppermost sheet-shaped medium 9B. Here, also when the leading end 9Bs of the second uppermost sheet-shaped medium 9B is lowered to a position below the upper ends 176*t* of the stoppers 176, the gap between the leading end 9Bs and the leading end 9As of the uppermost sheet-shaped medium 9A is fully secured.

When finishing the first operation, the feeder 1 blows air from the air nozzle 48 in the tip-end air blower.

Here, air from the air nozzle 48 is blown between the uppermost sheet-shaped medium 9A and the second uppermost sheet-shaped medium 9B as indicated with an arrow of a two-dot chain line in FIG. 14 by way of example. Thus, the second uppermost sheet-shaped medium 9B is fully separated from the uppermost sheet-shaped medium 9A with an inflow of air.

When the suction portion 41 moves forward toward the transporter 45 to pass the uppermost sheet-shaped medium 9A sucked by the suction portion 41 to the transporter 45, the second uppermost sheet-shaped medium 9B is prevented from being transported and passed to the transporter 45 together with the uppermost sheet-shaped medium 9A.

Thus, in the feeder 1, regardless of when the sheet-shaped media 9 stacked on the mount surface 21 of the mount portion 20A include the second uppermost sheet-shaped medium 9B with the upwardly bent transportation leading-end portion 9Bc, the second uppermost sheet-shaped medium 9B is prevented from being passed to the transporter 45 together with the uppermost sheet-shaped medium 9A or from being transported in an overlapped manner.

The feeder 1 performs an operation (third operation) of lowering the mount portion 20A to a position below the normal position as an example of the first operation. This operation physically lowers the mount portion 20A unlike in another example of the first operation. This operation thus easily allows the upwardly bent leading-end portion 9Bc of the second uppermost sheet-shaped medium 9B to be spaced apart downward from the uppermost sheet-shaped medium 9A sucked by the suction portion 41.

Modification Examples

The disclosure is not limited to the structure examples illustrated in the exemplary embodiments, and may include modification examples described below.

As the second operation serving as the first operation according to the first exemplary embodiment, an operation of temporarily stopping air flow from the edge air blowers may be employed.

When the second operation is employed, the raised upper sheet-shaped media 9T no longer receive the raising effect. Thus, when the stop time lasts for a predetermined long duration, the upper sheet-shaped media 9T are lowered to a position to substantially overlap the mount surface 21 of the mount portion 20A or the sheet-shaped media 9 stacked on the mount surface 21 without being raised. Thus, in the feeder 1, when the overlap-transport prevention control is performed, a sufficiently large gap is secured between the leading end 9As of the sucked uppermost sheet-shaped medium 9A and the leading end 9Bs of the second uppermost sheet-shaped medium 9B.

As an example of the third operation serving as the first operation according to the second exemplary embodiment, in addition to the operation of lowering the mount portion 20A to a position below the normal position, an operation of reducing the air flow from the edge air blowers further than in the normal operation or stopping the air flow may also be performed.

In this structure, the effect of raising the raised upper sheet-shaped media 9T is lowered or eliminated when the mount portion 20A is lowered to a position below the normal position. Thus, the raised upper sheet-shaped media 9T are reliably lowered. Thus, in the feeder 1, when the overlap-transport prevention control is performed, a sufficiently large gap is secured between the leading end 9As of the sucked uppermost sheet-shaped medium 9A and the leading end 9Bs of the second uppermost sheet-shaped medium 9B.

The first exemplary embodiment has described an example of the second operation of reducing the air flow from all the air outlets 50A, 50B, 50C, and 50D forming part of the edge air blowers to reduce the air flow from the edge air blowers further than in the normal operation.

However, in the second operation, the air flow from only the air outlets 50 located close to the transportation leading ends 9*s* of the stacked sheet-shaped media 9, among the air outlets 50 (a pair of air outlets 50A and 50B on the left and a pair of air outlets 50D and 50E on the right) located on the left and right and at different positions in the transport direction D, may be reduced further than in the normal operation or may be stopped. In the case of the edge air blowers according to the first exemplary embodiment, for example, the second operation is applicable to only the air outlet 50C on the right.

In this structure, while the second operation is performed, the effect of the edge air blowers raising the leading-end portions including at least the leading ends 9*s* of the raised upper sheet-shaped media 9T is lowered or eliminated. Thus, at least the leading-end portions are lowered. Thus, in the feeder 1, when the overlap-transport prevention control is performed, a gap is secured between the leading end 9As of the sucked uppermost sheet-shaped medium 9A and the leading end 9Bs of the second uppermost sheet-shaped medium 9B. In this case, regardless of when the stacked sheet-shaped media 9 include a sheet-shaped medium with an upwardly bent leading-end portion, an overlap transport of the sheet-shaped media 9 is easily prevented.

This modification example is also applicable to a modification example of the second exemplary embodiment (an example additionally including an operation of reducing the air flow from the edge air blowers further than in the normal operation or an operation of stopping the air flow).

Each of the exemplary embodiments has described an example where the detection information from the leading-end upward-bend detection sensor 74 is used as information requiring the overlap-transport prevention control including the first operation.

However, besides the above example, an example of information requiring the overlap-transport prevention control may be information indicating the presence of the sheet-shaped medium 9 with an upwardly bent leading-end portion when the sheet-shaped media 9 stacked on the mount portion 20A or 20B include the sheet-shaped medium 9 with the upwardly bent leading-end portion, or information input by a user and indicating selection of the overlap-transport prevention control. The user may input such information through the operation display device 16 or an external connection terminal.

Other examples usable as the information requiring the overlap-transport prevention control may include information of the environmental condition indicating that the humidity is lower than or equal to 20% RH, and information that the fed sheet-shaped media 9 are paper media with a basis weight of lower than or equal to 106 gsm.

Particularly, when information requiring the overlap-transport prevention control includes information that the fed sheet-shaped media 9 that are paper media with a basis weight of lower than or equal to 106 gsm are used under dry environmental conditions with a humidity of lower than or equal to 20% RH, the paper media are thin paper sheets with the transportation leading ends easily bent upward. In this case, an overlap transport of the paper media is more likely to be prevented.

As an example of the first operation including the overlap-transport prevention control, an operation (fourth operation) of lowering a downstream end of the mount surface 21 of the mount portion 20A or 20B in the transport direction D further than the normal position (height position h1) may be employed.

When the fourth operation is employed, to lower the corresponding end of the mount surface 21 of the mount portion 20A or 20B, the corresponding end of the mount portion 20A or 20B may be lowered by the lift 30 to a position below the normal position so that the entire mount surface 21 is inclined forward toward the downstream side in the transport direction D, or the corresponding end of the mount portion 20A or 20B may have a structure bendable downward.

In each of the exemplary embodiments, as an example of the suction portion 41 in the feeder 1, a suction portion formed from a suction belt transport mechanism including a suction transport belt may be used. The suction transport belt rotates to transport the uppermost sheet-shaped medium 9A to the transporter 45 in the transportation direction D while attracting the uppermost sheet-shaped medium 9A to a belt undersurface through suction.

Each exemplary embodiment has described, as an example of the sheet-shaped-medium handling apparatus 100, the image forming system 100A including the image forming apparatus 120A serving as the processing device 120, but this is not the only possible structure. The handling apparatus 100 may be any apparatus that includes the processing device 120 that performs predetermined processing on the sheet-shaped media 9 fed from the feeder 1.

Examples of the handling apparatus 100 include a printing system including the processing device 120 used as a printer that attaches ink to the sheet-shaped media 9 and other media, a painting system including the processing device 120 used as a painting device that applies a liquid paint to the sheet-shaped media 9 and other media, and a drying system including the processing device 120 used as a dryer that dries the sheet-shaped media 9 and other media.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A feeder comprising:

a mount board that moves vertically while allowing sheet-shaped media to be stacked thereon;

a transport device that allows an uppermost one of the sheet-shaped media stacked on the mount board to be sucked by a suction portion to transport the uppermost sheet-shaped medium to a transporter and to feed the uppermost sheet-shaped medium to a destination;

left and right edge air blowers that blow air to transportation left and right edge portions of upper ones of the sheet-shaped media stacked; and a tip-end air blower that blows air to below the uppermost sheet-shaped medium sucked by the suction portion from a position downstream from a transportation leading end of the uppermost sheet-shaped medium in a transport direction, wherein when the uppermost sheet-shaped medium is sucked by the suction portion, the feeder performs a first operation of spacing an upwardly bent transportation leading-end portion of a second uppermost sheet-shaped medium apart downward from the sucked uppermost sheet-shaped medium, wherein the left and right edge air blowers include a plurality of edge air blowers disposed at different positions in the transport direction of the sheet-shaped media, and wherein the first operation further includes an operation of reducing, further than in a normal operation, an air flow from at least one of the plurality of edge air blowers located close to transportation leading ends of the sheet-shaped media, or stopping the air flow.

2. The feeder according to claim 1, wherein the first operation further includes an operation of lowering the mount board to a position below a normal position.

3. The feeder according to claim 2, wherein the first operation further includes an operation of lowering a downstream end of the mount board in the transport direction to a position below a normal position.

4. The feeder according to claim 2, wherein the first operation is performed under environments with a humidity of lower than or equal to 20% RH and when the sheet-shaped media are paper media with a basis weight of lower than or equal to 106 gsm.

5. The feeder according to claim 1, further comprising:

a stopper that comes into contact with transportation leading ends of the sheet-shaped media at a position downstream of the mount board in the transport direction to restrict movement of the sheet-shaped media in the transport direction, wherein the first operation further includes an operation of lowering a transportation leading end of a second uppermost sheet-shaped medium to a position below an upper end of the stopper.

6. The feeder according to claim 5, wherein the first operation is performed under environments with a humidity of lower than or equal to 20% RH and when the sheet-shaped media are paper media with a basis weight of lower than or equal to 106 gsm.

7. The feeder according to claim 1, wherein the first operation is performed under environments with a humidity of lower than or equal to 20% RH and when the sheet-shaped media are paper media with a basis weight of lower than or equal to 106 gsm.

8. The feeder according to claim 1, further comprising:

a detector that detects that the transportation leading-end portion of any of the sheet-shaped media stacked on the mount board is bent upward, wherein the first operation is performed when the detector detects that the transportation leading-end portion of the second uppermost sheet-shaped medium is bent upward.

9. A sheet-shaped-medium handling apparatus, comprising:

a sheet-shaped-medium feeder that transports and feeds sheet-shaped media to be stacked to a destination; and a processing device that performs processing on the sheet-shaped media fed from the feeder, wherein the sheet-shaped-medium feeder includes the sheet-shaped-medium feeder according to claim 1.

10. A feeder comprising:

a mount board that moves vertically while allowing sheet-shaped media to be stacked thereon;

a transport device that allows an uppermost one of the sheet-shaped media stacked on the mount board to be sucked by a suction portion to transport the uppermost sheet-shaped medium to a transporter and to feed the uppermost sheet-shaped medium to a destination;

left and right edge air blowers that blow air to transportation left and right edge portions of upper ones of the sheet-shaped media stacked; and a tip-end air blower that blows air to below the uppermost sheet-shaped medium sucked by the suction portion from a position downstream from a transportation leading end of the uppermost sheet-shaped medium in a transport direction, wherein when the uppermost sheet-shaped medium is sucked by the suction portion, the feeder performs a second operation of reducing an air flow from the left and right edge air blowers further than in a normal operation or stopping the air flow, wherein the left and right edge air blowers include a plurality of edge air blowers disposed at different positions in the transport direction of the sheet-shaped media, and wherein the second operation is an operation of reducing, further than in a normal operation, an air flow from at least one of the plurality of edge air blowers located close to transportation leading ends of the sheet-shaped media, or stopping the air flow.

11. The feeder according to claim 10, further comprising:

a stopper that comes into contact with transportation leading ends of the sheet-shaped media at a position downstream of the mount board in the transport direction to restrict movement of the sheet-shaped media in the transport direction, wherein the second operation further includes an operation of lowering a transportation leading end of a second uppermost sheet-shaped medium to a position below an upper end of the stopper.

12. The feeder according to claim 10, wherein the second operation is performed under environments with a humidity of lower than or equal to 20% RH and when the sheet-shaped media are paper media with a basis weight of lower than or equal to 106 gsm.

* * * * *